US005417170A

United States Patent [19]

Eshleman

[11] Patent Number: 5,417,170

[45] Date of Patent: May 23, 1995

[54] SLOPED-BOTTOM PYROLYSIS CHAMBER AND SOLID RESIDUE COLLECTION SYSTEM IN A MATERIAL PROCESSING APPARATUS

[76] Inventor: Roger D. Eshleman, 506 Clayton Ave., Waynesboro, Pa. 17268

[21] Appl. No.: 299,034

[22] Filed: Aug. 31, 1994

Related U.S. Application Data

[63] Continuation of Ser. No. 123,455, Sep. 17, 1993.

[51] Int. Cl.[6] ..... F23G 3/04; F23G 5/00

[52] U.S. Cl. ..... 110/235; 110/229; 110/250

[58] Field of Search ..... 110/166, 229, 234, 235, 110/250, 255, 267, 289, 290

[56] References Cited

U.S. PATENT DOCUMENTS

| | | | |
|---|---|---|---|
| 695,868 | 3/1902 | Nevegold | 110/289 |
| 997,529 | 7/1911 | Wilson | 110/229 |
| 3,467,035 | 9/1969 | Anderson et al. | 110/250 |
| 4,206,186 | 6/1980 | Holter et al. | 423/230 |
| 4,495,873 | 1/1985 | Blankenship | 110/250 |
| 4,513,671 | 4/1985 | Eshleman | 110/101 CF |
| 4,531,464 | 7/1985 | Eshleman | 110/259 |
| 4,598,649 | 7/1986 | Eshleman | 110/211 |
| 4,599,141 | 7/1986 | Shultz | 201/2.5 |
| 4,635,899 | 1/1987 | Eshleman | 251/298 |
| 4,646,713 | 3/1987 | Honigsbaum | 126/79 |
| 4,726,301 | 2/1988 | Des Ormeaux et al. | 110/250 |
| 4,759,300 | 7/1988 | Hansen et al. | 110/229 |
| 4,802,424 | 2/1989 | McGinnis, III et al. | 110/250 |
| 4,924,785 | 5/1990 | Schultz et al. | 110/346 |
| 4,934,283 | 6/1990 | Kydd | 110/246 |
| 4,949,652 | 8/1990 | Hadley | 110/215 |
| 4,970,970 | 11/1990 | Avery | 110/246 |
| 5,065,680 | 11/1991 | Cheetham | 110/342 |
| 5,279,234 | 1/1994 | Bender et al. | 110/210 |

*Primary Examiner*—Henry A. Bennett
*Assistant Examiner*—William C. Doerrler
*Attorney, Agent, or Firm*—Michael L. R. Swartz; John R. Flanagan

[57] ABSTRACT

A material processing apparatus includes a casing having a pyrolysis chamber for receiving and pyrolyzing feed materials therein into fluid materials and a mass of refractory material contained in the casing upon the bottom thereof and spaced from the top thereof. The refractory mass extends between the opposite ends and sides of the casing and includes an upper surface defining a bottom of the pyrolysis chamber. The upper surface is defined in an inclined orientation extending between the opposite ends of the chamber. The refractory mass has an elongated cavity extending along one end of the casing and adjacent to a lower end of the upper inclined surface. An elongated residue collection pan is disposed in the cavity and is removable through an opening in a side of the casing. Elongated heating units are disposed in the pyrolysis chamber above and generally parallel to the cavity and upper inclined surface for producing heating therein to cause pyrolyzing of the feed materials into fluid materials.

19 Claims, 20 Drawing Sheets

SLOPED-BOTTOM PYROLYSIS CHAMBER AND SOLID RESIDUE COLLECTION SYSTEM IN A MATERIAL PROCESSING APPARATUS

This is a continuation of application Ser. No. 08/123,455 filed on Sep. 17, 1993.

CROSS REFERENCE TO RELATED APPLICATIONS

Reference is hereby made to the following copending U.S. applications dealing with subject matter related to the present invention:

1. "Apparatus And Method For Controlled Processing Of Materials" by Roger D. Eshleman and Paul S. Stevers, assigned U.S. Ser. No. 07/987,928 and filed Dec. 9, 1992.
2. "Multiple Unit Material Processing Apparatus" by Roger D. Eshleman, assigned U.S. Ser. No. 987,929 and filed Dec. 9, 1992.
3. "Heat Generator Assembly In A Material Processing Apparatus" by Roger D. Eshleman, assigned U.S. Ser. No. 07/987,936 and filed Dec. 9, 1992.
4. "Casing And Heater Configuration In A Material Processing Apparatus" by Roger D. Eshleman, assigned U.S. Ser. No. 07/987,946 and filed Dec. 9, 1992.
5. "Apparatus And Method For Transferring Batched Materials" by Roger D. Eshleman, assigned U.S. Ser. No. 08/026,719 and filed Mar. 5, 1993.
6. "Material Transport Pusher Mechanism In A Material Processing Apparatus" by Roger D. Eshleman, assigned U.S. Ser. No. 08/123,747 and filed Sep. 17, 1993.
7. "Heater and Tunnel Arrangement In A Material Processing Apparatus" by Roger D. Eshleman, assigned U.S. Ser. No. 08/123,396 and filed Sep. 17, 1993.
8. "Improved Casing and Heater Configuration In A Material Processing Apparatus" by Roger D. Eshleman, assigned U.S. Ser. No. 08/123,454 and filed Sep. 17, 1993.

BACKGROUND OF THE INVENTION

1. Field of the Invention

The present invention generally relates to material processing and, more particularly, is concerned with an apparatus for controlled processing of materials, such as the disposal of medical and other diverse waste material, particularly on-site where the waste material is produced.

2. Description of the Prior Art

The problem of disposal of waste matter involves a material processing challenge that is becoming increasingly acute. The primary material processing methods of waste disposal have been burning in incinerators and burial in landfills. These two material processing methods have severe disadvantages. Burning of waste liberates particulate matter and fumes which contribute to pollution of the air. Burial of wastes contributes to the contamination of ground water. A third material processing method is recycling of waste. Although increasing amounts of waste are being recycled, which alleviates the problems of the two primary material processing methods, presently available recycling methods do not provide a complete solution to the waste disposal problem.

The problem of disposal of biomedical waste materials is even more acute. The term "biomedical waste materials" is used herein in a generic sense to encompass all waste generated by medical hospitals, laboratories and clinics which may contain hazardous, toxic or infectious matter whose disposal is governed by more stringent regulations than those covering other waste. It was reported in *The Wall Street Journal* in 1989 that about 13,000 tons a day of biomedical waste, as much as 20% of it infectious, is generated by around 6,800 U.S. hospitals.

Hospitals and other generators of biomedical waste materials have employed three main material processing methods of waste handling and disposal: (1) on-site incineration with only the residue transferred to landfills; (2) on-site steam autoclaving and followed by later transfer of the waste to landfills; and (3) transfer of the waste by licensed hazardous waste haulers to off-site incinerators and landfills. Of these three main material processing methods, theoretically at least, on-site disposal is the preferred one.

However, many hospital incinerators, being predominantly located in urban areas, emit pollutants at a relatively high rate which adversely affect large populations of people. In the emissions of hospital incinerators, the Environmental Protection Agency (EPA) has identified harmful substances, including metals such as arsenic, cadmium and lead; dioxins and furans; organic compounds like ethylene, acid gases and carbon monoxide; and soot, viruses, and pathogens. Emissions of these incinerators may pose a public health threat as large as that from landfills.

Nonetheless, on-site disposal of biomedical waste materials still remains the most promising solution. One recent on-site waste disposal unit which addresses this problem is disclosed in U.S. Pat. No. 4,934,283 to Kydd. This unit employs a lower pyrolyzing chamber and an upper oxidizing chamber separated by a movable plate. The waste material is deposited in the lower chamber where it is pyrolyzed in the absence of air and gives off a combustible vapor that, in turn, is oxidized in the upper chamber. While this unit represents a step in the right direction, it does not appear to approach an optimum solution to the problem of biomedical waste material disposal.

One problem with the approach of the aforementioned patent is that it proposes the use of an on-site waste disposal unit which is dedicated to the disposal of biomedical waste material. This approach requires that more than one incineration system be installed and maintained at hospitals, namely, one for biomedical waste and another for all other hospital waste. Resistance has been encountered to the adoption of this approach by hospitals due to added cost of installation, operation and maintenance. An urgent need has developed for an all-purpose material processing apparatus which can handle disposal of all types of hospital waste materials, both biomedical waste and general waste, such as metal needles and glass and plastic bottles.

SUMMARY OF THE INVENTION

The present invention provides a diverse material processing apparatus designed to satisfy the aforementioned needs. While the apparatus of the present invention can be used in different applications, it is primarily useful in as an apparatus for waste disposal and particularly as an apparatus for disposing of biomedical and general hospital waste material on-site where the waste material is produced. A greater than 95% reduction in mass and volume is achieved as is the complete destruction of all viruses and bacteria. The residue is a sterile, inert inorganic powder, which is non-hazardous, non-leachable and capable of disposal as ordinary trash.

The preferred embodiment of the present invention includes various unique features for facilitating the processing of material and particularly the disposing of diverse waste material. Although some of these features comprise inventions claimed in the sixth through eighth copending applications cross-referenced above, all are illustrated and described herein for facilitating a complete and thorough understanding of the those of the features comprising the present invention.

Accordingly, the present invention is directed to a diverse material processing apparatus which comprises: (a) a casing having a top and bottom, a pair of opposite ends and a pair of opposite sides, the casing defining a pyrolysis chamber for receiving and pyrolyzing feed materials therein into fluid materials; and (b) a mass of refractory material contained in the casing upon the bottom thereof and spaced below the top thereof, the refractory mass extending between the opposite ends and opposite sides thereof. The refractory mass includes an upper surface defining a bottom of the pyrolysis chamber and having a pair of opposite upper and lower ends. The upper surface is defined in an inclined orientation extending from the upper end thereof located adjacent to one of the opposite ends of the casing to a lower end thereof located adjacent to the other of the opposite ends of the casing.

The refractory mass also has an elongated cavity defined therein along one of the opposite ends of the casing and adjacent to the lower end of the upper inclined surface of the refractory mass. The cavity extends between the bottom of the casing and the upper surface on the refractory mass in a position to receive residue of pyrolyzed feed materials from the lower end of the upper inclined surface of the refractory mass. An elongated residue collection pan is disposed in the elongated cavity and is removable through an opening in the one of the opposite side of the casing. A plurality of heater elements are disposed below the collection pan and between the bottom of the casing and the collection pan for producing heating of the collection pan to elevate the temperature of materials therein.

The material processing apparatus further includes means disposed in communication with the pyrolysis chamber for producing heating in the pyrolysis chamber to cause the pyrolyzing of the feed materials into fluid materials. The heating producing means includes at least one elongated electric heater unit disposed in the pyrolysis chamber above and extending in generally parallel relation to the cavity in the refractory mass and a plurality of electric heater units disposed in the pyrolysis chamber along the respective sides of the casing and extending in generally parallel relation to the upper inclined surface of the refractory mass.

These and other features and advantages and attainments of the present invention will become apparent to those skilled in the art upon a reading of the following detailed description when taken in conjunction with the drawings wherein there is shown and described illustrative embodiments of the invention.

BRIEF DESCRIPTION OF THE DRAWINGS

In the course of the following detailed description, reference will be made to the attached drawings in which.

DETAILED DESCRIPTION OF THE INVENTION

Figure 1:
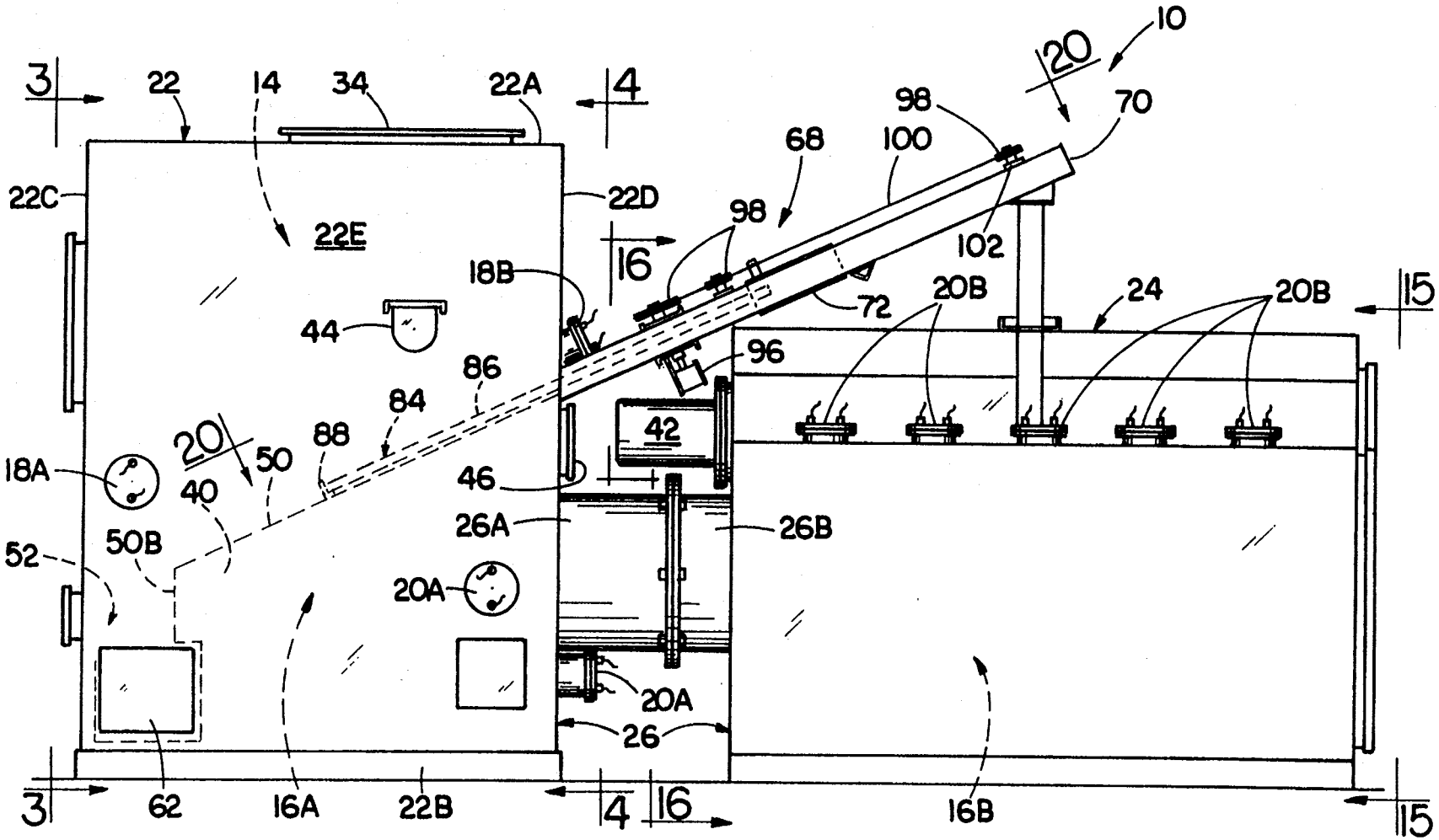
FIG. 1 is a side elevational view of an apparatus for processing of a wide variety of diverse materials, particularly all types of biomedical and other waste materials generated by health care institutions, such as hospitals.
Figure 2:
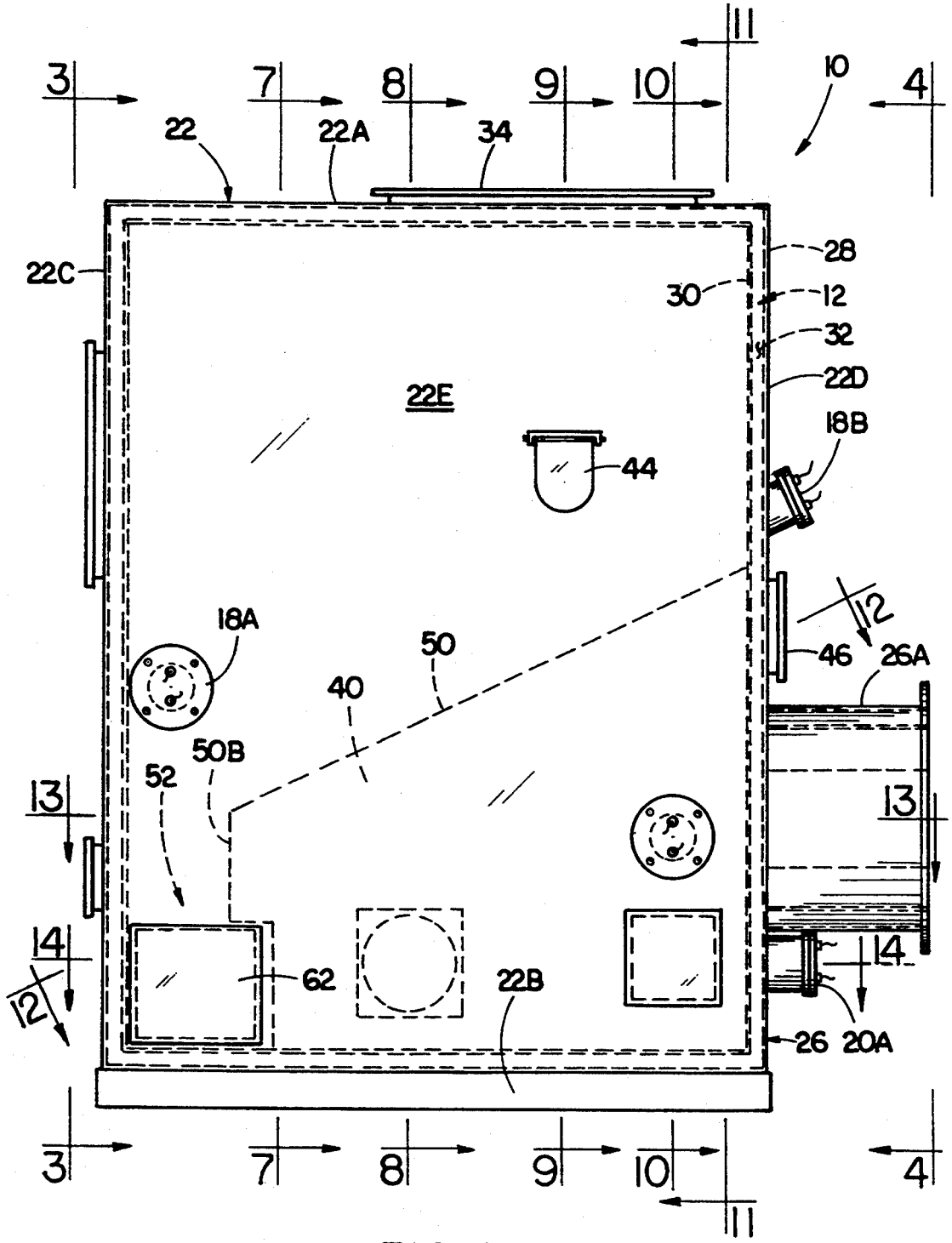
FIG. 2 is an enlarged side elevational view of a first housing unit of the apparatus of FIG. 1.
Figure 3:
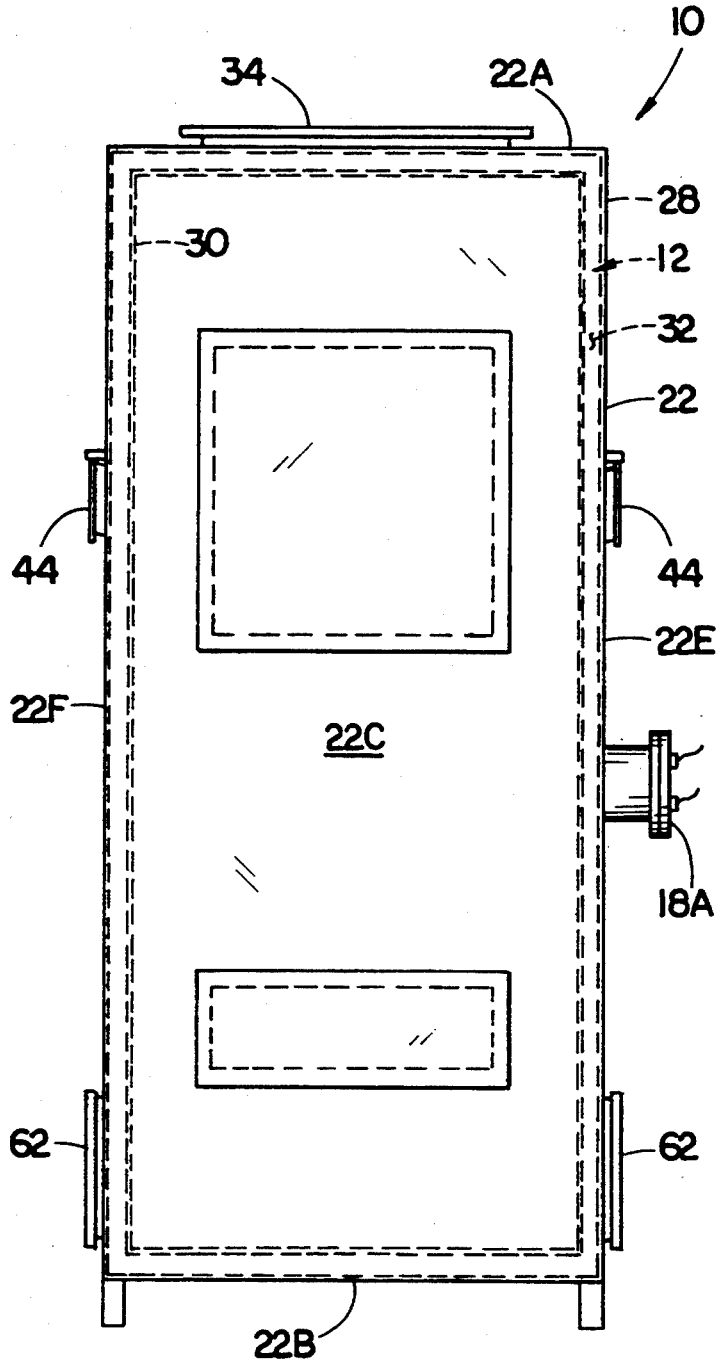
FIG. 3 is a front end elevational view of the first housing unit of the apparatus as seen along line 3—3 of FIGS. 1 and 2.
Figure 4:
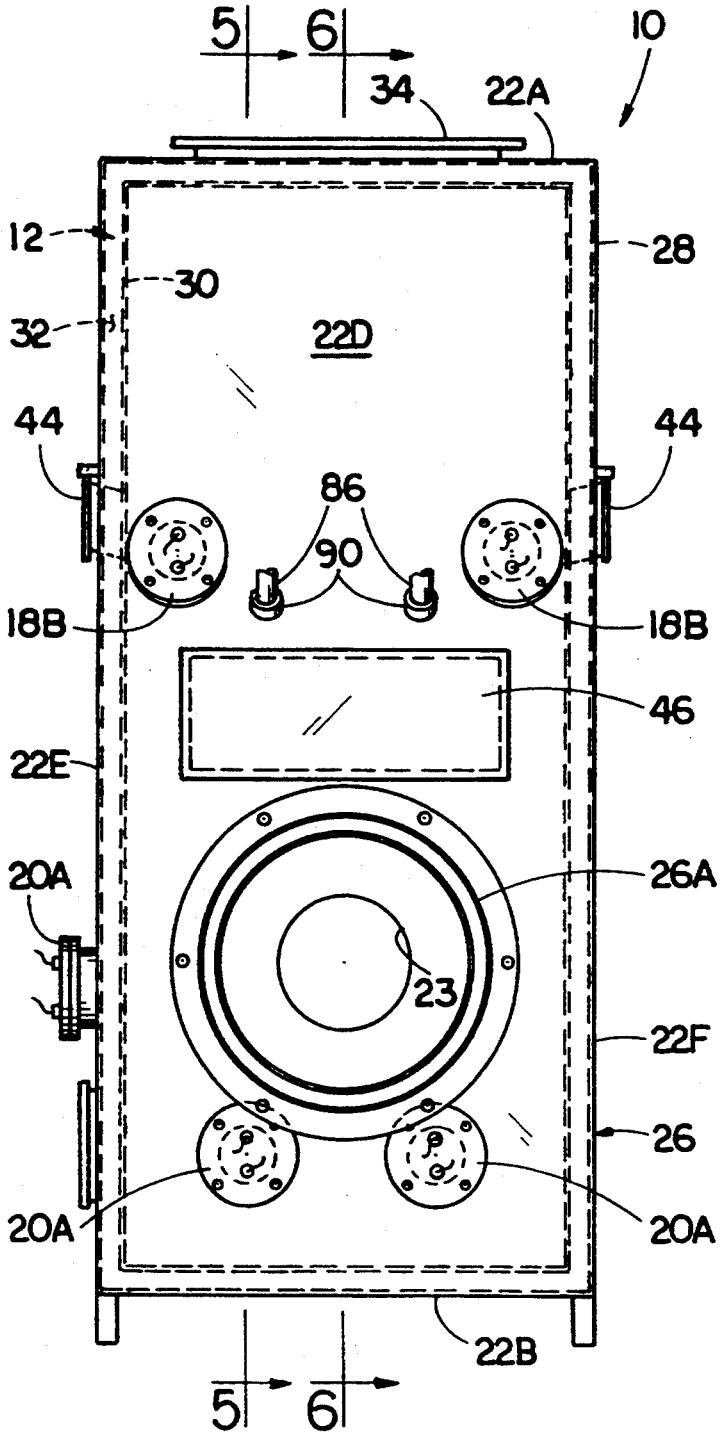
FIG. 4 is a rear end elevational view of the first housing unit of the apparatus as seen along line 4—4 of FIGS. 1 and 2.
Figure 5:
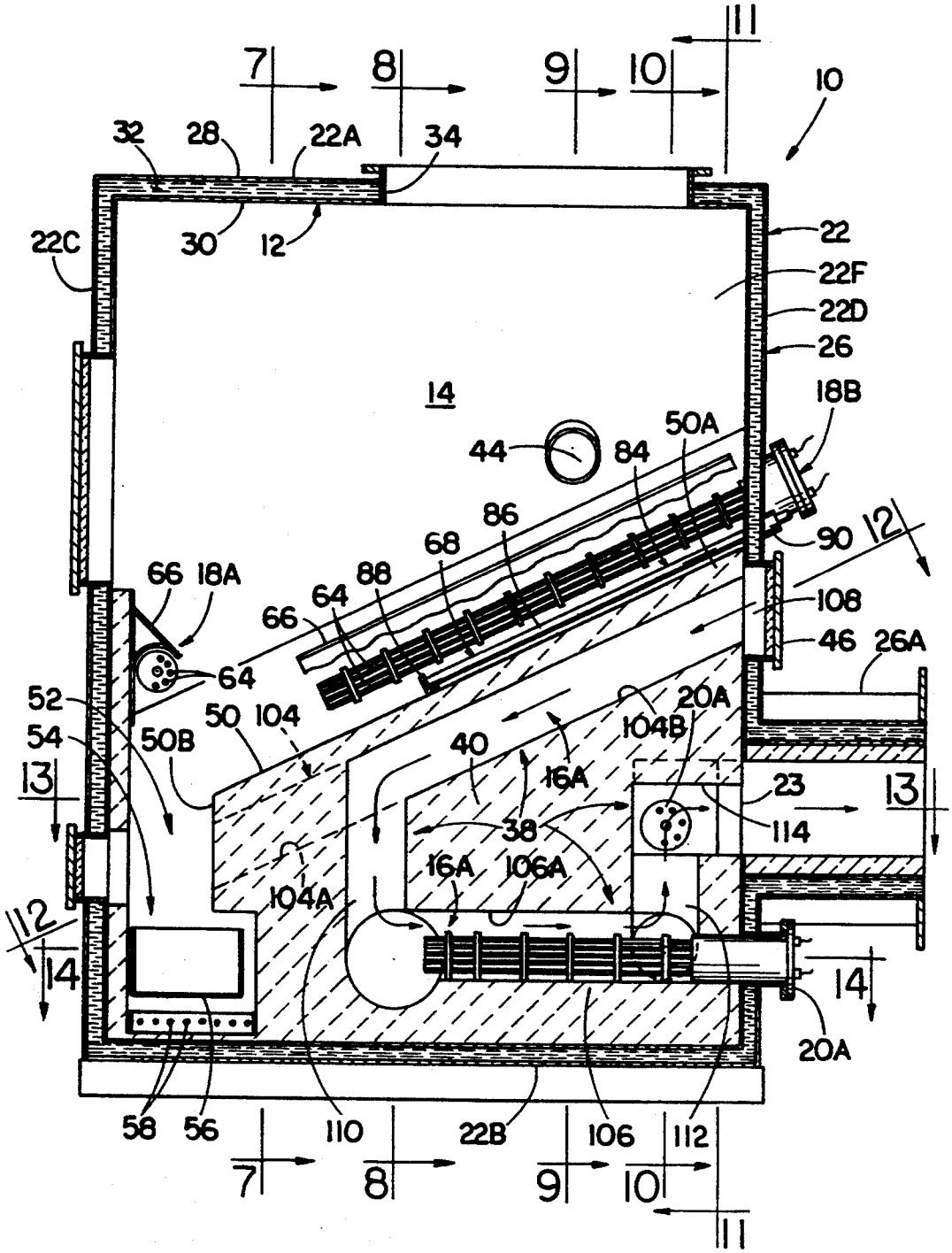
FIG. 5 is a longitudinal vertical sectional view of the first housing unit of the apparatus taken along line 5—5 of FIG. 4.
Figure 6:
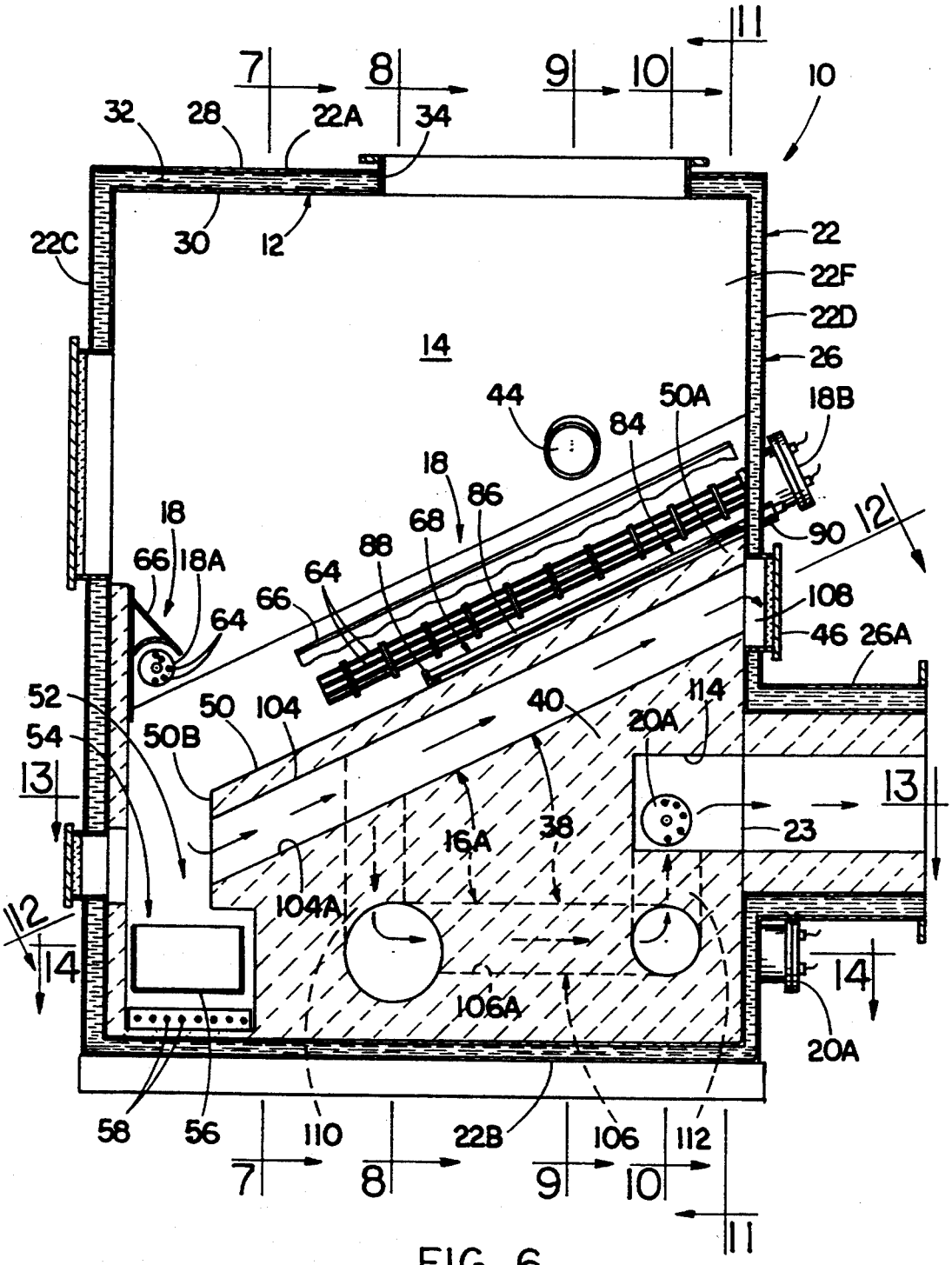
FIG. 6 is a longitudinal vertical sectional view of the first housing unit of the apparatus taken along line 6—6 of FIG. 4.
Figure 7:
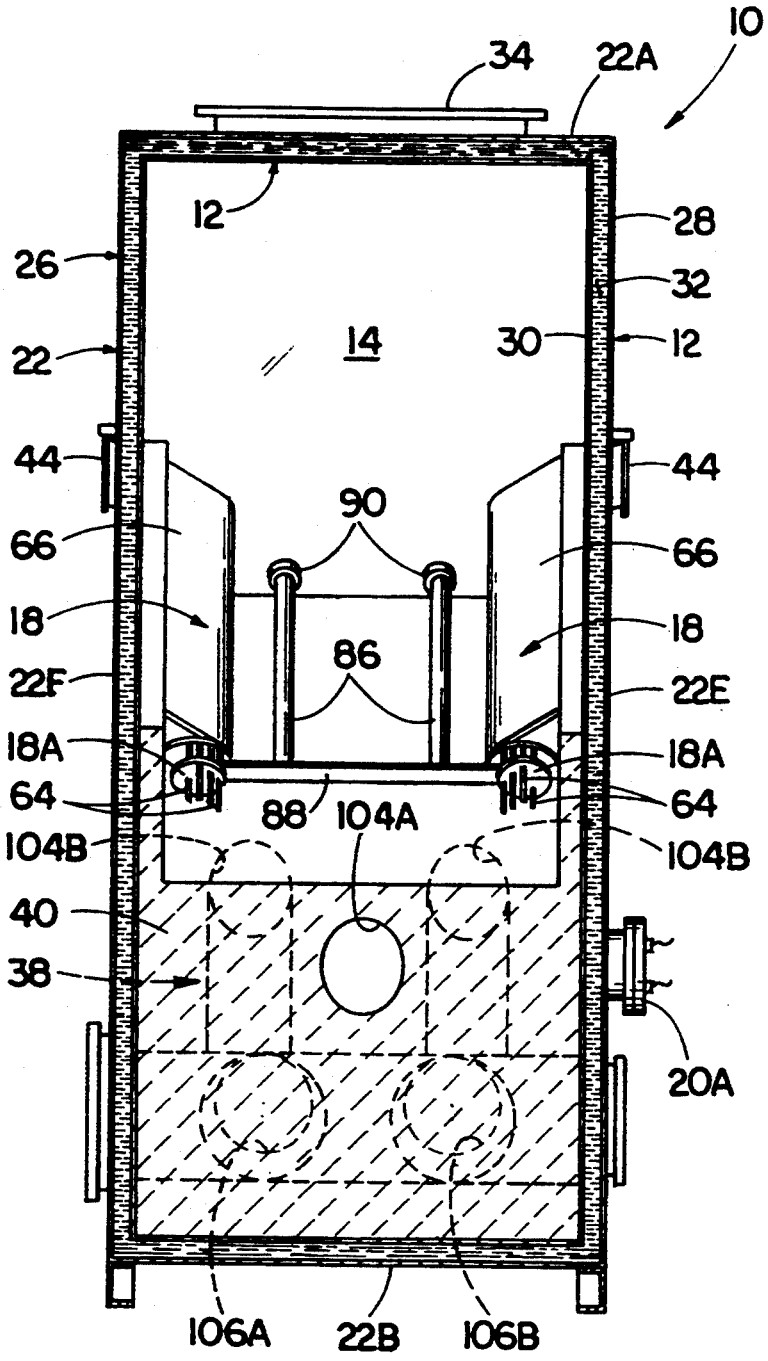
FIG. 7 is a vertical cross-sectional view of the first housing unit of the apparatus taken along line 7—7 of FIGS. 2, 5 and 6.
Figure 8:
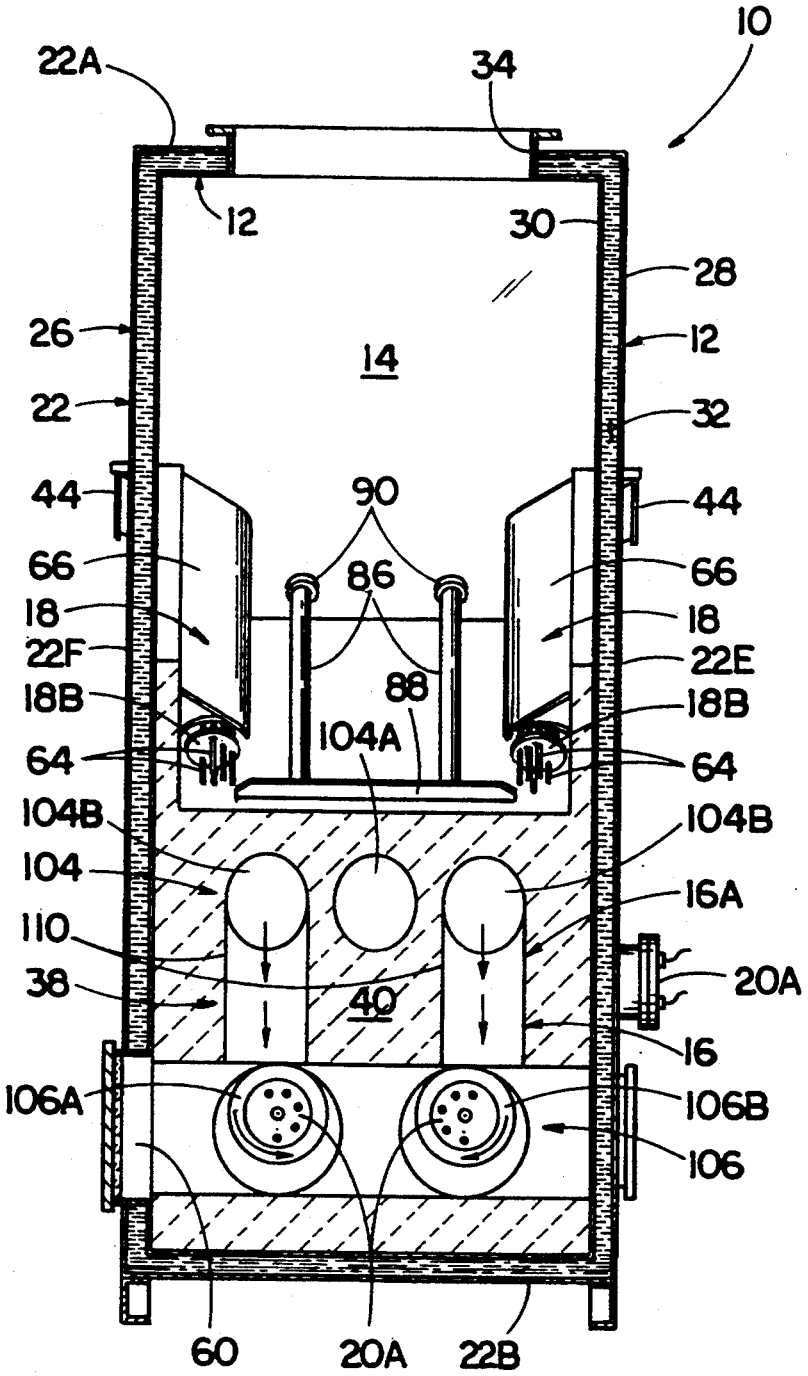
FIG. 8 is a vertical cross-sectional view of the first housing unit of the apparatus taken along line 8—8 of FIGS. 2, 5 and 6.
Figure 9:
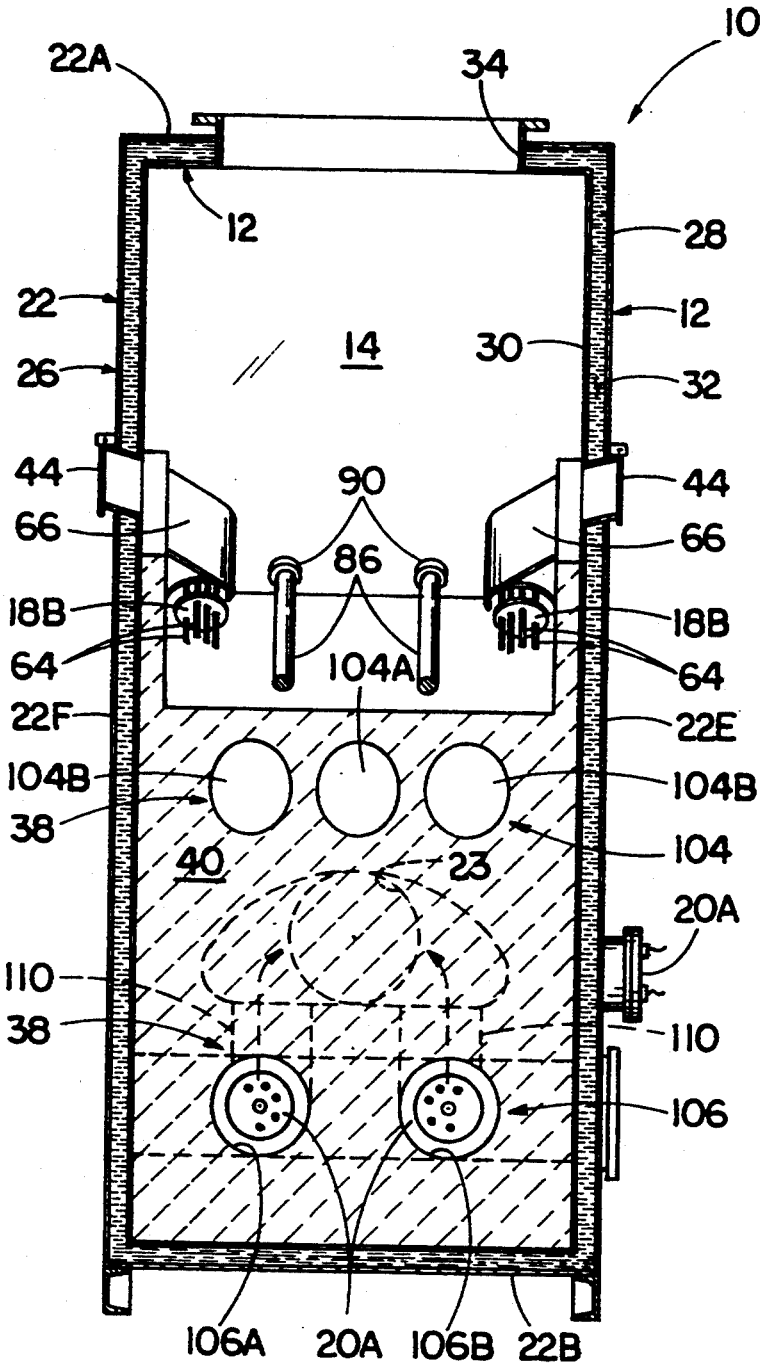
FIG. 9 is a vertical cross-sectional view of the first housing unit of the apparatus taken along line 9—9 of FIGS. 2, 5 and 6.
Figure 10:
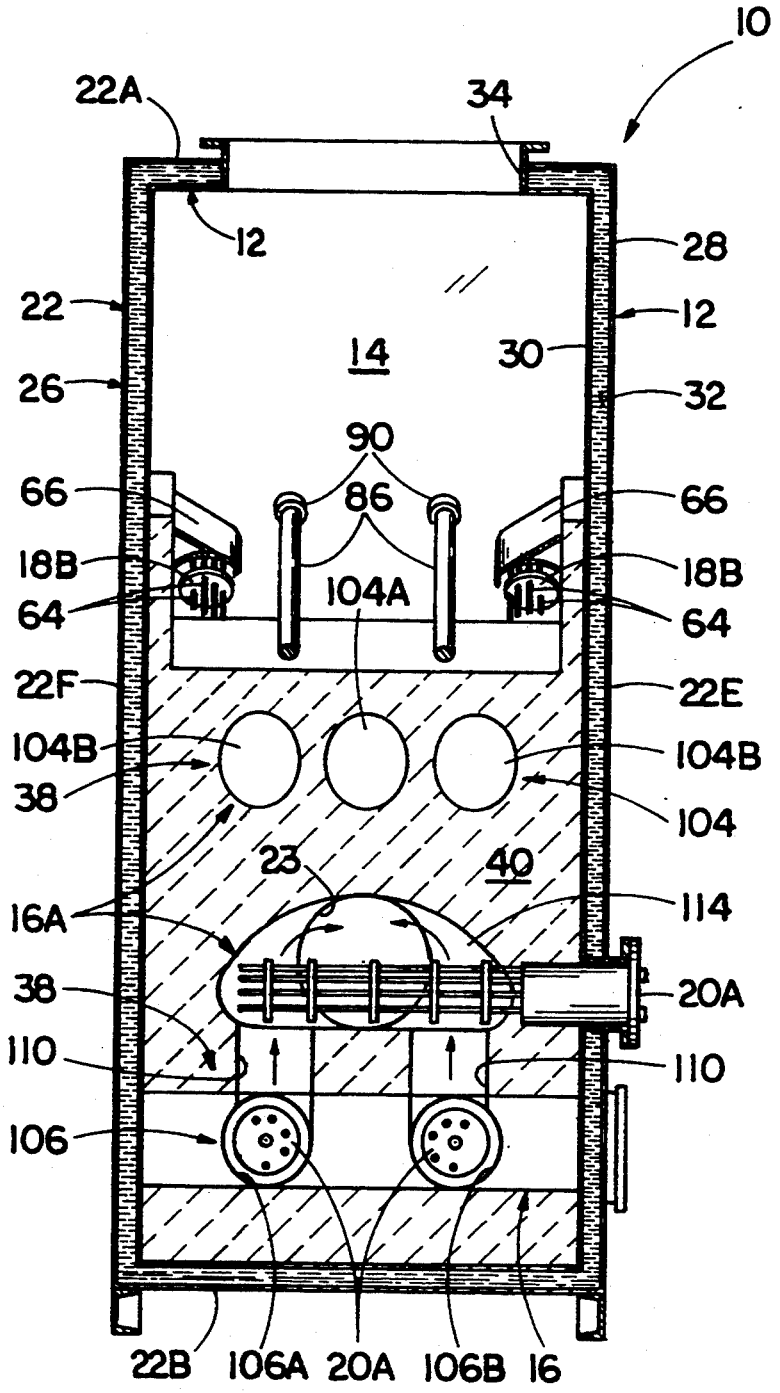
FIG. 10 is a vertical cross-sectional view of the first housing unit of the apparatus taken along line 10—10 of FIGS. 2, 5 and 6.
Figure 11:
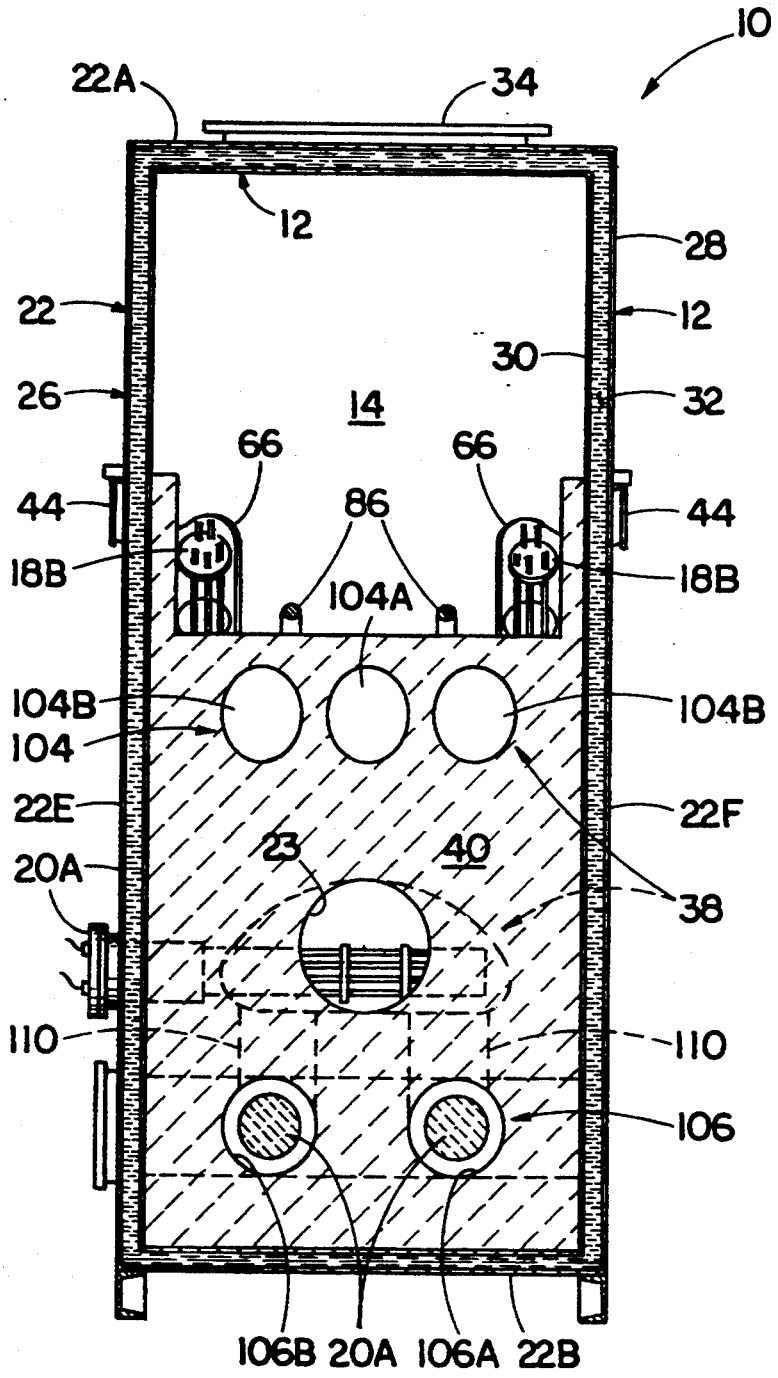
FIG. 11 is a vertical cross-sectional view of the first housing unit of the apparatus taken along line 11—11 of FIGS. 2, 5 and 6.
Figure 12:
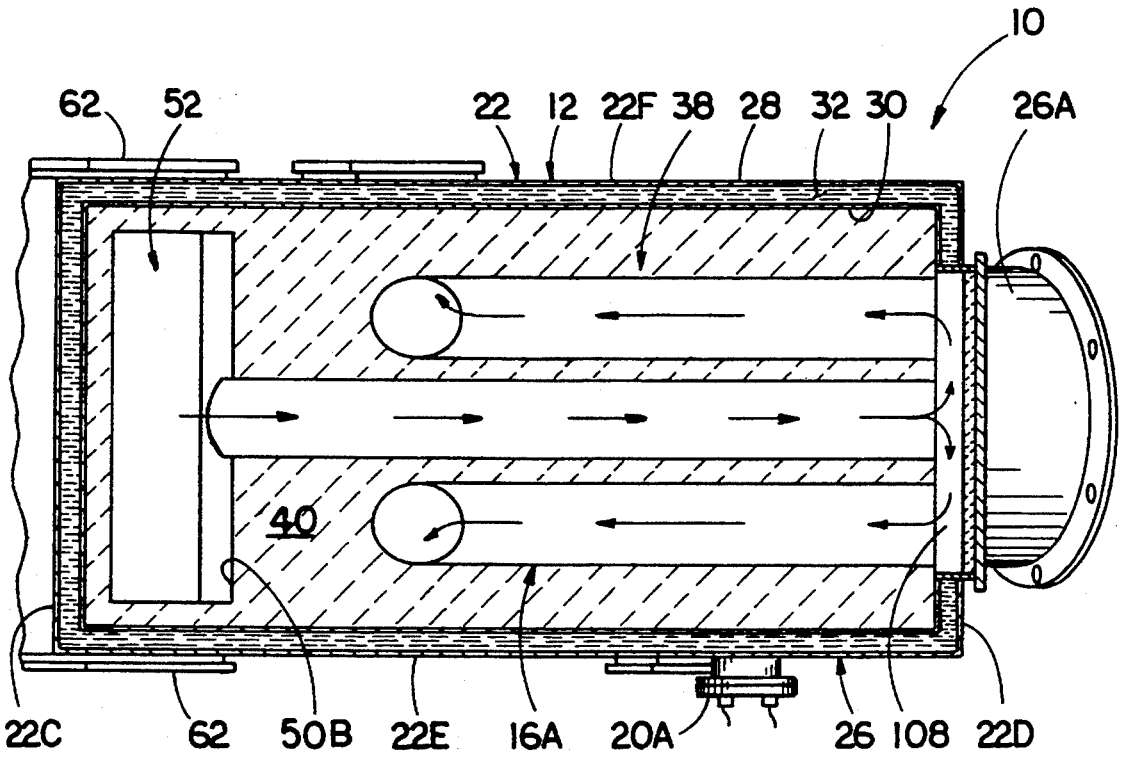
FIG. 12 is a horizontal sectional view of the first housing unit of the apparatus taken along line 12—12 of FIGS. 2, 5 and 6.
Figure 13:
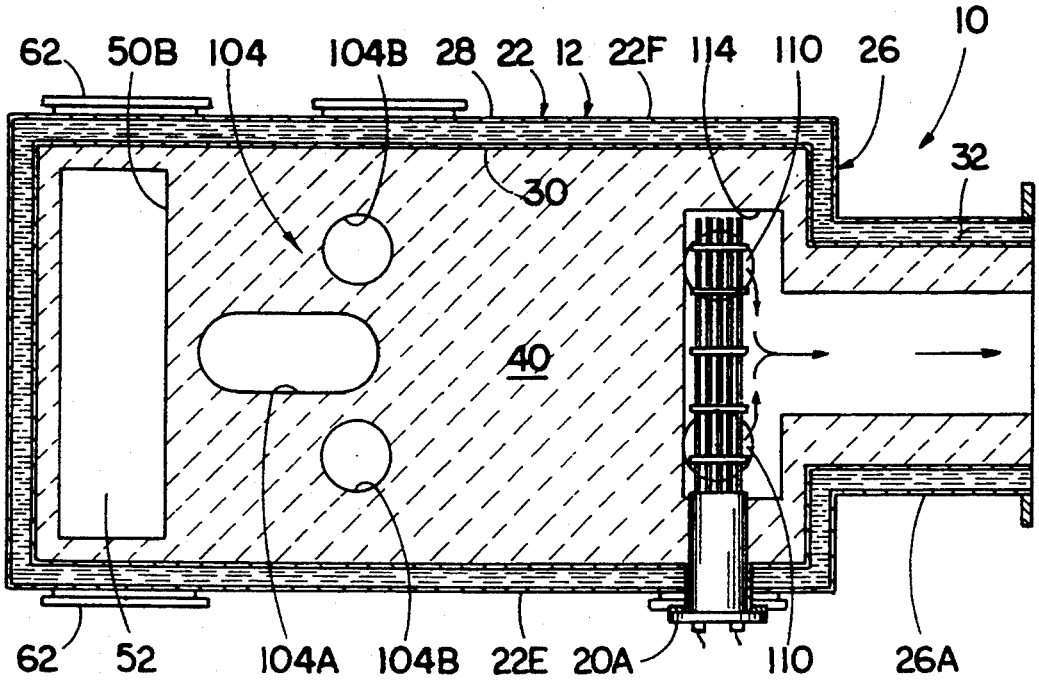
FIG. 13 is a horizontal sectional view of the first housing unit of the apparatus taken along line 13—13 of FIGS. 2, 5 and 6.
Figure 14:
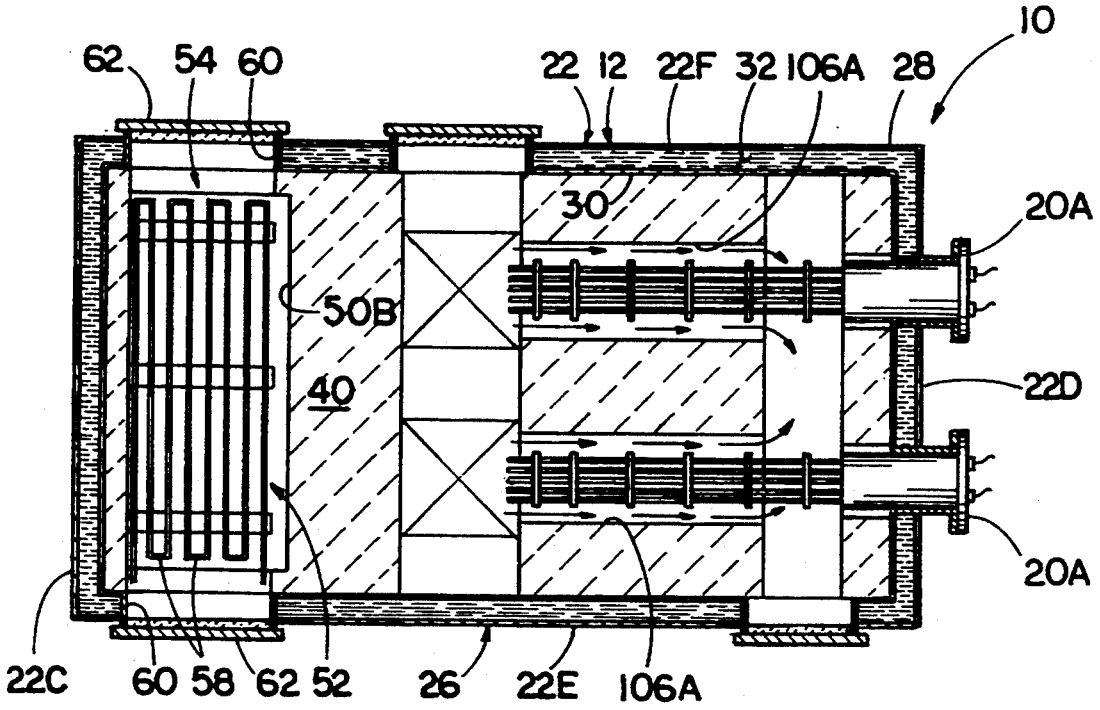
FIG. 14 is a horizontal sectional view of the first housing unit of the apparatus taken along line 14—14 of FIGS. 2, 5 and 6.
Figure 15:
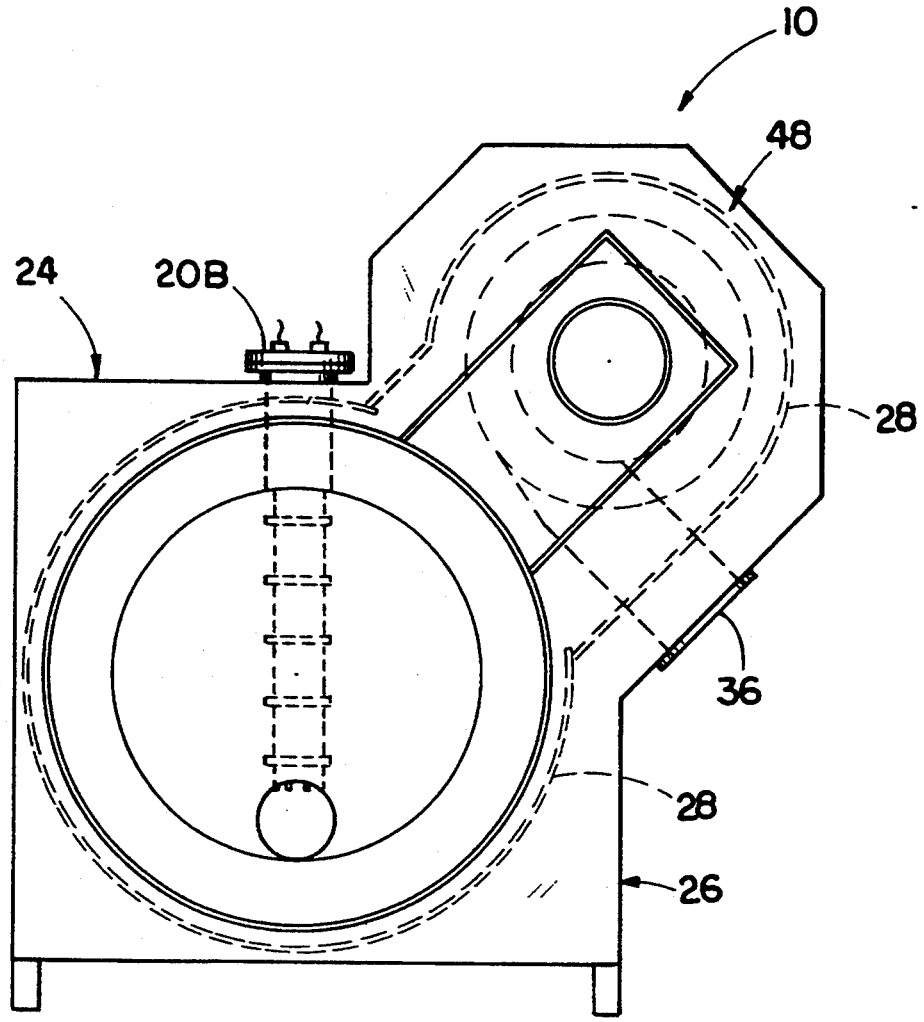
FIG. 15 is an enlarged front end elevational view of the second housing unit of the apparatus as seen along line 15—15 of FIG. 1.
Figure 16:
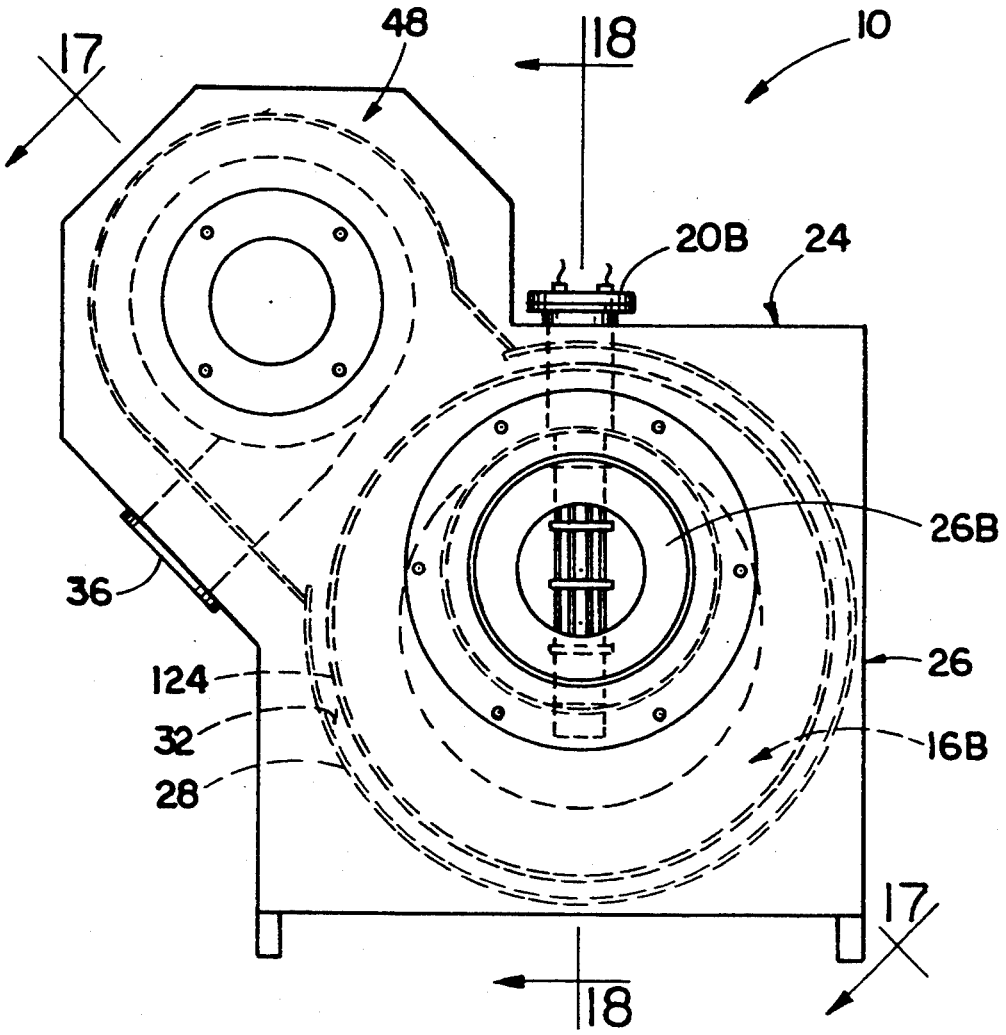
FIG. 16 is an enlarged rear end elevational view of the second housing unit of the apparatus as seen along line 16—16 of FIG. 1.
Figure 17:
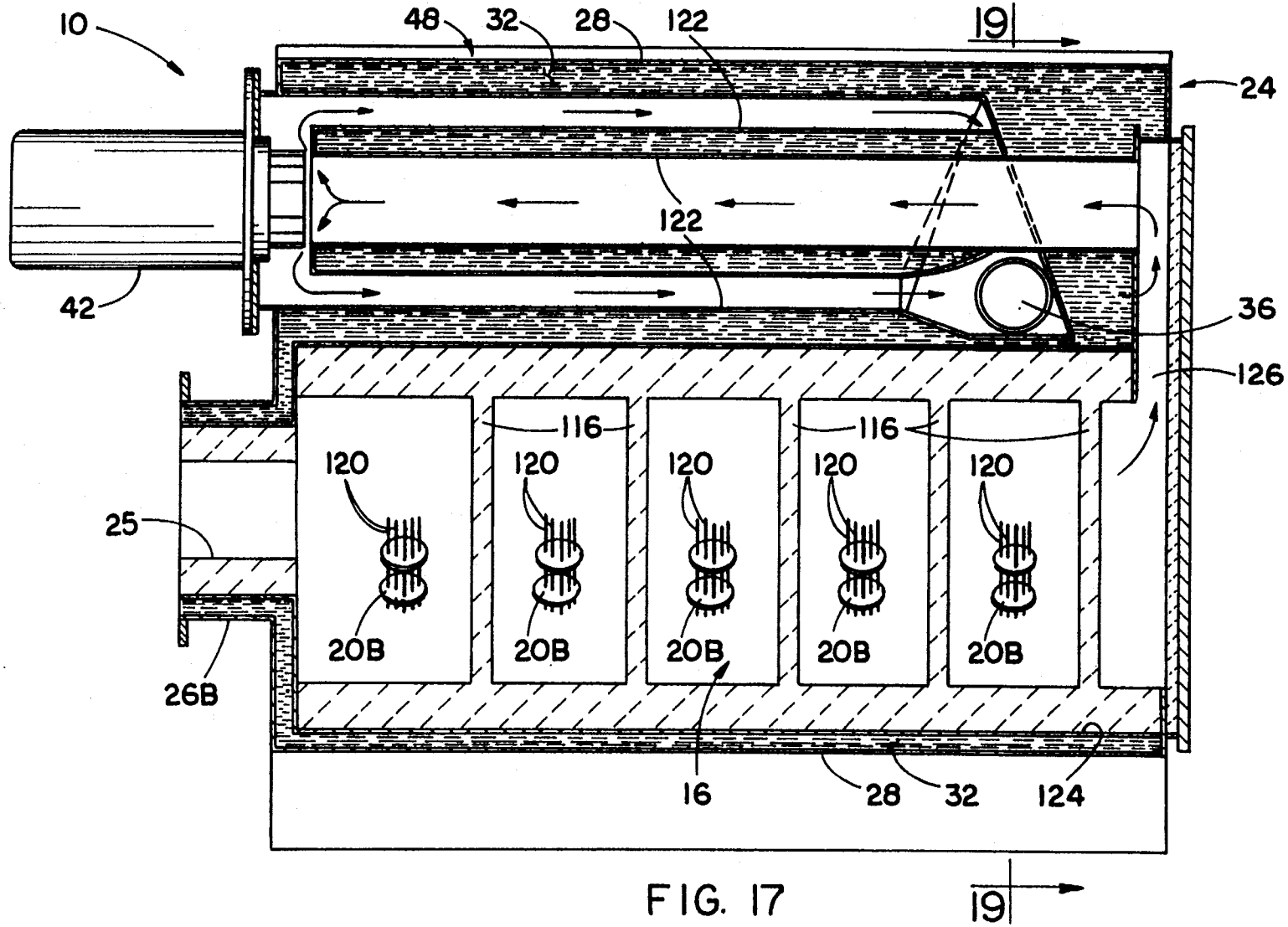
FIG. 17 is an inclined sectional view of the second housing unit of the apparatus taken along line 17—17 of FIG. 16.
Figure 18:
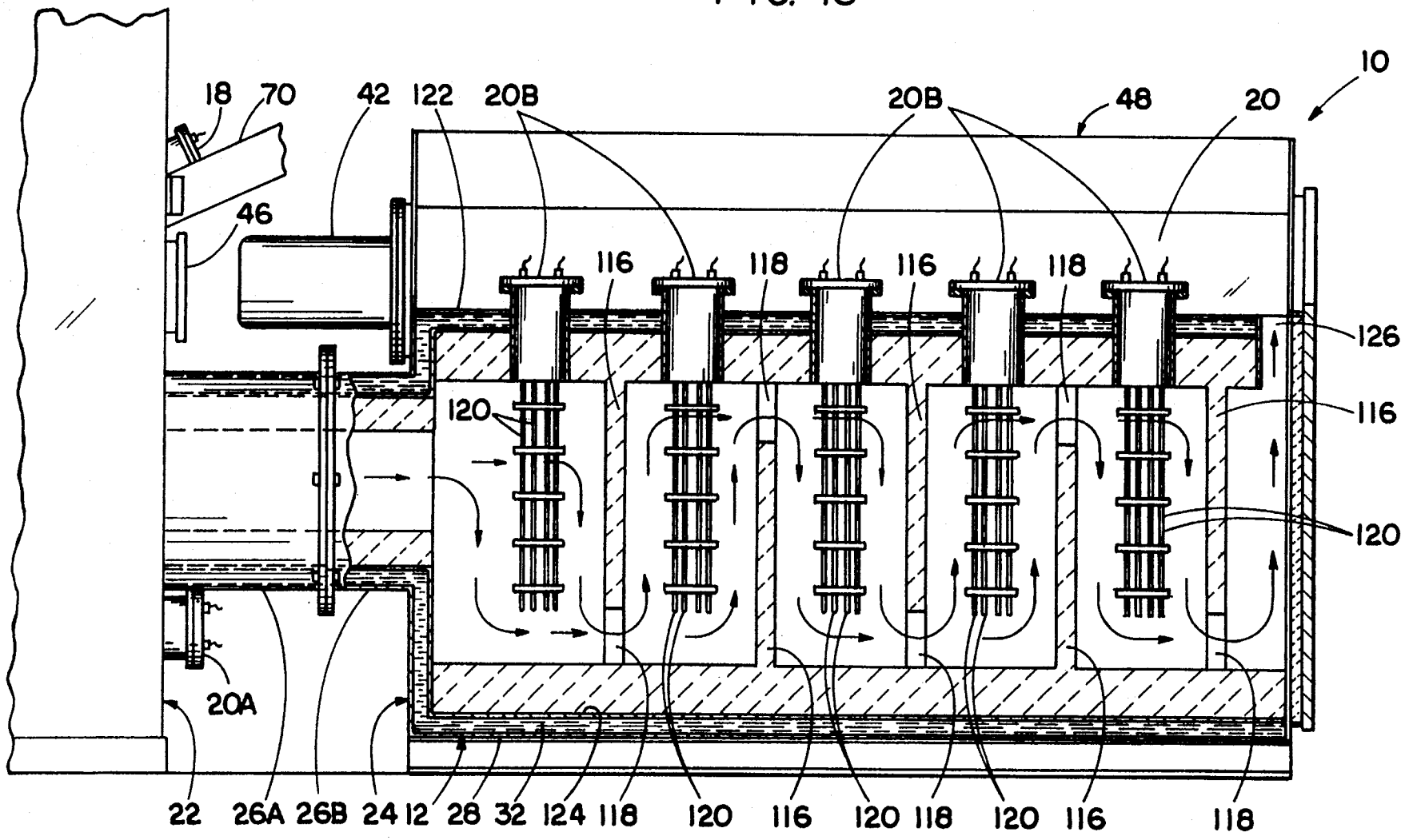
FIG. 18 is a vertical sectional view of the second housing unit of the apparatus taken along line 18—18 of FIG. 16.
Figure 19:
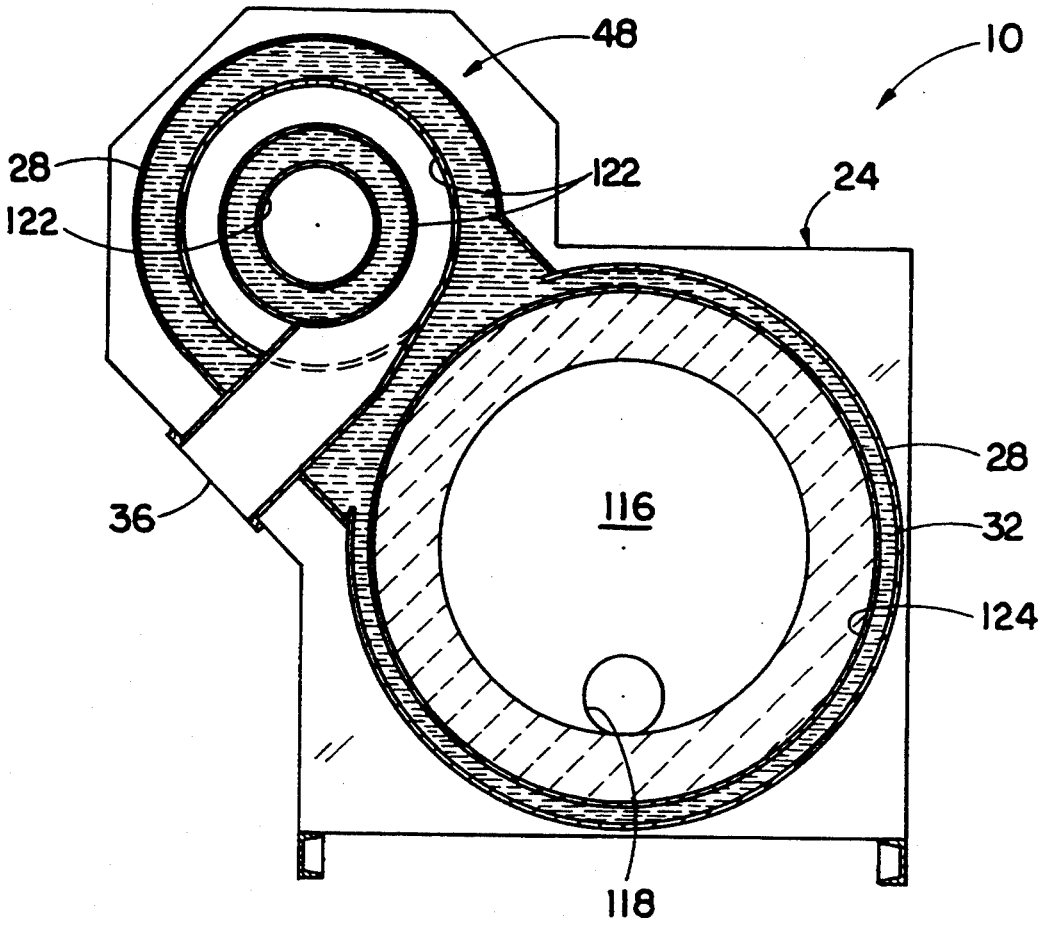
FIG. 19 is a cross-sectional view of the second housing unit of the apparatus taken along line 19—19 of FIG. 17.

In the following description, like reference characters designate like or corresponding parts throughout the several views. Also in the following description, it is to be understood that such terms as "forward", "rearward", "left", "right", "upwardly", "downwardly", and the like, are words of convenience and are not to be construed as limiting terms.

Diverse Material Processing Apparatus—In General

Referring now to the drawings, and particularly to FIGS. 1, 2, 5, 6, 17 and 18, there is illustrated an apparatus, generally designated 10, for controlled processing of diverse materials, and in particular for controlled disposal of all types of biomedical and other waste materials generated by health care institutions, such as hospitals, which includes features in accordance with the present invention. The material processing apparatus 10 basically includes a coolant jacketed vessel 12 defining a first pyrolysis chamber 14 and a second oxidation chamber 16. The apparatus 10 also includes a plurality of first heater units 18 mounted in the first chamber 14 of the vessel 12 and being operable to electrically generate heat for pyrolyzing materials in the first chamber 14, and a plurality of second heater units 20 mounted in the second chamber 16 of the vessel 12 and being operable to electrically generate heat for oxidizing materials in the second chamber 16. The first and second heater units 18, 20 have substantially the same construction and function as those disclosed in the third patent application cross-referenced above, which disclosure is incorporated herein by reference.

The apparatus 10, being provided in the form of two separate first and second units 22, 24 which are disposed in end-to-end relation to one another, has a casing 26 with outer and inner spaced walls 28, 30 forming the coolant jacketed airtight pressure vessel 12 inside of the inner wall 30 and providing a channel 32 between the outer and inner walls 28, 30. The channel 32 surrounds the vessel 12 and contains the flow of coolant fluid, such as water. The casing 26 of the apparatus 10 includes a pair of tubular extensions 26A, 26B which are fastened together to interconnect an outlet 23 of the first unit 22 with an inlet 25 of the second unit 24 in flow communication with one another.

Referring to FIGS. 1–19, the vessel 12 defines the first pyrolysis chamber 14 having an inlet 34 and the second oxidation chamber 16 connected in communication with the first pyrolysis chamber 14 and having the discharge outlet 36. The first chamber 14 in which the materials will be pyrolyzed receives the materials through the inlet 34 via operation of a suitable loading mechanism (not shown), such as the one disclosed in the fifth patent application cross-referenced above, the disclosure of which is incorporated herein by reference. The first chamber 14 of the vessel 12 for pyrolyzing materials is disposed in the first unit 22. The material, through pyrolysis, or burning in a starved oxygen atmosphere, is converted to a gas that exits the first chamber 14 by passing into the second chamber 16.

The second chamber 16 receives the pyrolyzed materials from the first chamber 14 and, after oxidizing the pyrolyzed materials therein, discharges the oxidized materials therefrom through the discharge outlet 36. The second chamber 16 has primary and secondary sections 16A, 16B for oxidizing materials in two successive stages. The primary section 16A is disposed in the first unit 22 of the vessel 12 between the first chamber 14 and the tubular extensions 26A, 26B. The secondary section 16B is disposed in the second unit 24 of the vessel 12. The primary section 16A is defined by a system 38 of interconnected passages or tunnels defined in a mass 40 of refractory material contained in the bottom of the first unit 22. The secondary section 16B of the second chamber 16 is located in the second unit 24. The oxidized gas from the primary section 16A of the second chamber 16 flows through the tunnel system 38 in the refractory mass 40 and then through the tubular extensions 26A, 26B, and into the secondary section 16B in the second unit 24.

The apparatus 10 further includes an air flow generating means, preferably an induction fan 42 connected in flow communication with the first and second chambers 14, 16, and first and second airflow inlet valves 44, 46 connected to the jacketed vessel 12. The induction fan 42 and first and second inlet valves 44, 46 are controlled in a manner disclosed in the first patent application cross-referenced above, the disclosure of which is incorporated herein by reference, so as to function to produce separate primary and secondary variable flows of air respectively into and through the first and second chambers 14, 16.

Additionally, as seen in FIGS. 15–17 and 19, the apparatus 10 includes a heat exchanger 48 connected in flow communication between the second chamber 16 and the discharge outlet 36. The heat exchanger 48 functions to remove heat from and thereby cool the coolant flowing through the channel 32 defined by jacketed vessel 12. The material processing apparatus 10 operates through one cycle to process, that is to pyrolyze and oxidize, a batch of the diverse waste material. The heat exchanger 48 is also located in the second unit 24 above the secondary section 16B of the second chamber 16. The upper heat exchanger 48 has the induction fan 42 connected at one end which operates to draw the gases from the first chamber 14 into the primary section 16A of the second chamber 16 via the tunnel system 38 and the secondary section 16B of the second chamber 16, then up and forwardly through the center of the heat exchanger 48 to the center of the induction fan 42 which then forces the exhaust gas outwardly and rearwardly around and along the heat exchanger 48 for exiting through discharge outlet 36 into a wet scrubber (not shown). The exhaust gas is virtually free of any pollution and the original material has been almost completely oxidized so that only a very small amount of fine minute dust or powder particles are collected in a particle separator (not shown).

Also, as disclosed in the first cross-referenced application, the apparatus 10 includes temperature sensors (not shown) which are mounted on the vessel 12 for sensing the temperatures in the first and second chambers 14, 16 and in the coolant circulating about the channel 32 defined by the jacketed vessel 12 about the first and second chambers 14, 16. Further, as disclosed in the first cross-referenced application, the apparatus 10 includes a gas sensor (not shown) which is mounted on a discharge outlet 36 of the vessel 12 for sensing the concentration of a predetermined gas, for example oxygen, in the discharge gases. Still further, as disclosed in the first cross-referenced application, the apparatus 10 incorporates a computer-based control system for controlling and directing the overall operation of the apparatus. The control system is responsive to the temperatures sensed in the first and second chambers 14, 16 by temperature sensors (not shown) and in the coolant circulating through the channel 32 of the jacketed vessel 12 by another temperature sensor (not shown). The control system also is responsive to the proportion of the predetermined gas, such as oxygen, sensed in the discharge gases by the gas sensor (not shown). The control system, in response to these various temperatures sensed and to the proportion of oxygen sensed, operates to adjust the ratio of or proportion the amount of primary air flow to the amount of secondary air flow through the first and second inlet valves 44, 46 into the first and second chambers 14, 16. Also, the control system, in response to these various temperatures sensed and to the proportion of oxygen sensed, operates to control the operation of the induction fan 42 so as to adjust the amounts (but not proportion) of primary and secondary air flows into the first and second chambers 14, 16.

Sloped-Bottom Pyrolysis Chamber And Solid Residue Collection System

Referring to FIGS. 1–14, the first unit 22 of the casing 26 has a top 22A and bottom 22B, a pair of opposite front and rear ends 22C, 22D and a pair of opposite sides 22E, 22F. The refractory mass 40 is contained in the first unit 22 upon the bottom 22B thereof and extends between the opposite ends 22C, 22D and opposite sides 22E, 22F thereof. The refractory mass 40 has an upper surface 50 spaced below the top 22A of the first unit 22. The upper surface 50 defines a bottom of the first pyrolysis chamber 14 and has a pair of opposite upper and lower ends 50A, 50B. The upper surface 50 has an inclined orientation extending upwardly and rearwardly from the front end 22C to the rear end 22D of the first unit 22. The refractory mass 40 also has an elongated cavity 52 defined therein along the front end 22C of the first unit 22 of the casing 26 and adjacent to and below the lower front end 50B of the upper inclined surface 50 of the refractory mass 40. The cavity 52 has a generally rectangular cross-section and extends between bottom 22B of the casing 26 and the upper surface 50 on the refractory mass 40.

The material processing apparatus 10 also includes a solid residue collection system 54 having an elongated collection pan 56 disposed in the elongated cavity 52 and a plurality of elongated heater elements 58 disposed below the collection pan 56 and above the bottom 22B of the casing 26. The collection pan 56 is removable through either one of a pair of opposite openings 60 defined in the opposite sides 22E, 22F of the first unit 22 of the casing 26. The openings 60 which provide access from the exterior to the interior of the first unit 22 are covered by removable closures 62. The heater elements 58 are provided to produce heating of the collection pan 56 so as to elevate the temperature of materials therein to cause pyrolysis of any organic material remaining in the ash.

The material processing apparatus 10 further includes means disposed in communication with the first pyrolysis chamber 14 for producing heating therein to cause the pyrolyzing of the feed materials into fluid materials therein. The heating producing means includes the plurality of elongated electric first heater units 18 disposed in the first pyrolysis chamber 14. One first heater unit 18A is mounted at one end through the one side 22E of the first unit 22 and is disposed above and extends in generally parallel relation to the cavity 52 in the refractory mass 40. The other two first heater units 18B are mounted at their one ends through the rear end 22D of the first unit 22 and are disposed in the first pyrolysis chamber 14 along the respective opposite sides 22E, 22F of the casing 26 and spaced above and extending in generally parallel relation to the upper inclined surface 50 of the refractory mass 40. The first heater units 18 are powered and controlled by the computer-based control system (not shown) for producing heating of materials received in the first chamber 14 to cause pyrolyzing of the materials into gases. Each first heater unit 18 includes a plurality of elongated electric heating elements 64 which extend in generally parallel relation to one another and are constructed of electrically-resistive material operable for emitting heat radiation.

Also, the heating producing means includes a plurality of elongated deflector structures 66 each being mounted to either the front end 22C or opposite sides 22E, 22F of the first unit 22 adjacent to and along a corresponding one of the first heating units 18. The deflector structure 66 associated with each first heater unit 18 extends in circumferential relation partially about the electric heating elements 64 thereof so as to deflect the heat radiation in a desired direction away from the electric heating elements 64 and from the adjacent front end and sides of the first unit 22. The deflector structure 66 has substantially the same construction and function as that disclosed in the third patent application cross-referenced above, which disclosure is incorporated herein by reference.

Material Transport Pusher Mechanism

Referring to FIGS. 1, 5, 6, 9 and 20–23, the material processing apparatus 10 also includes a pusher mechanism 68 for transporting material across the upper inclined surface 50 of the refractory mass 40 which is the bottom of the first chamber 14. The pusher mechanism 68 functions to prevent buildup of non-consumable materials, such as glass and certain metals, upon the upper inclined surface 50 from where they would be difficult to remove once they have cooled. The pusher mechanism 68 is mounted to and extends through the rear end 22D of the first unit 22 of the casing 26 and is operable to engage and push the materials across the upper inclined surface 50 of the refractory mass 40 along a path extending parallel to the direction from the upper end 50A toward the lower end 50B of the upper surface 50 and thereby into the collection pan 56 seated within the cavity 52 adjacent the front end 22C of the casing 26.

Figures 20, 21:
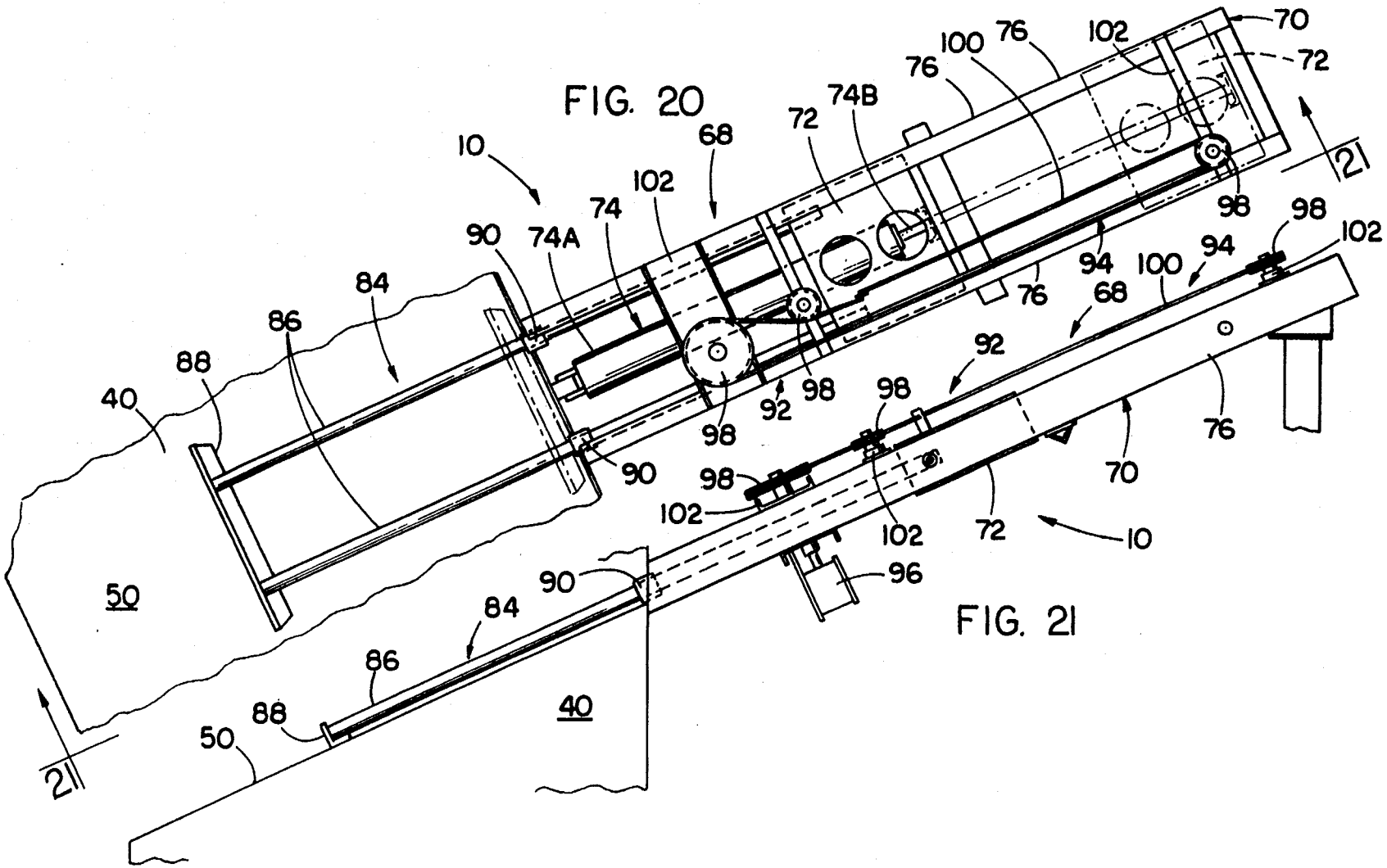
FIG. 20 is a top plan view of a pusher mechanism mounted to the first housing unit of the apparatus taken along line 20—20 of FIG. 1.
FIG. 21 is a side elevational view of the pusher mechanism as seen along line 21—21 of FIG. 20.
Figure 22:
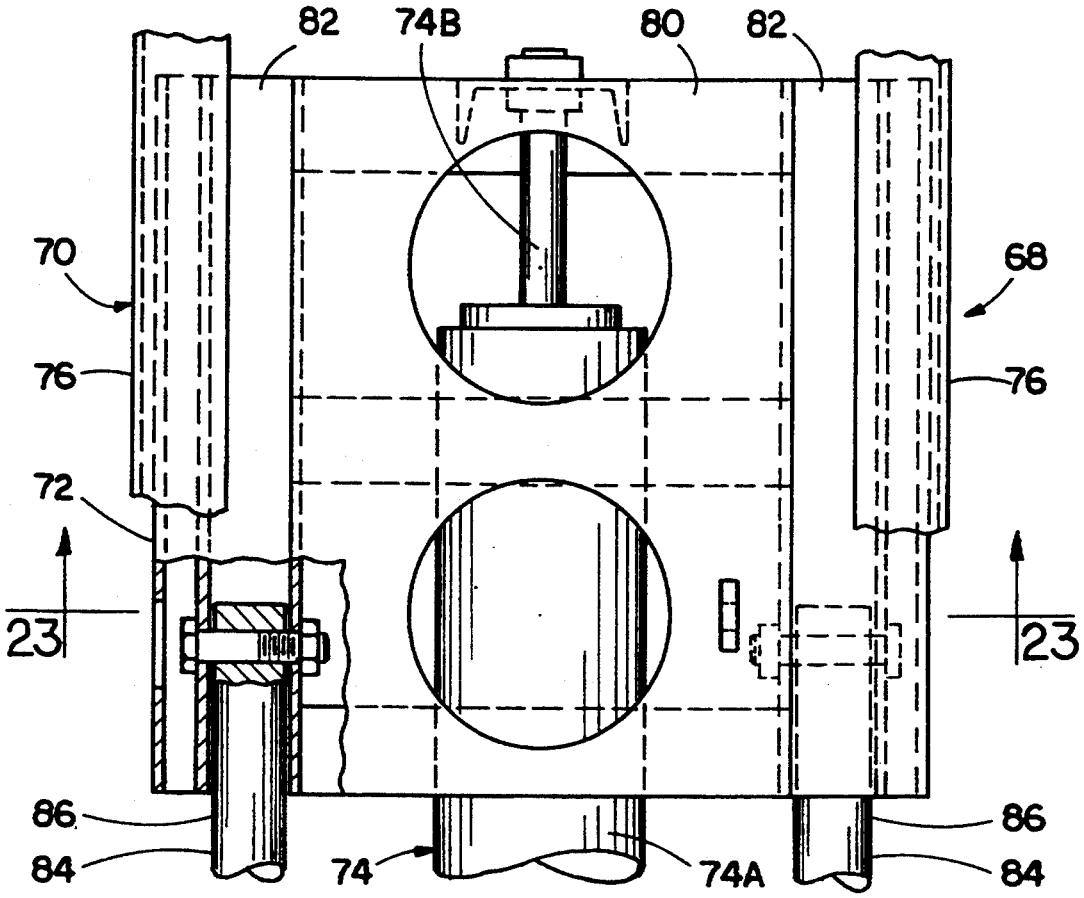
FIG. 22 is an enlarged view of a portion of the pusher mechanism of FIG. 20.
Figure 23:
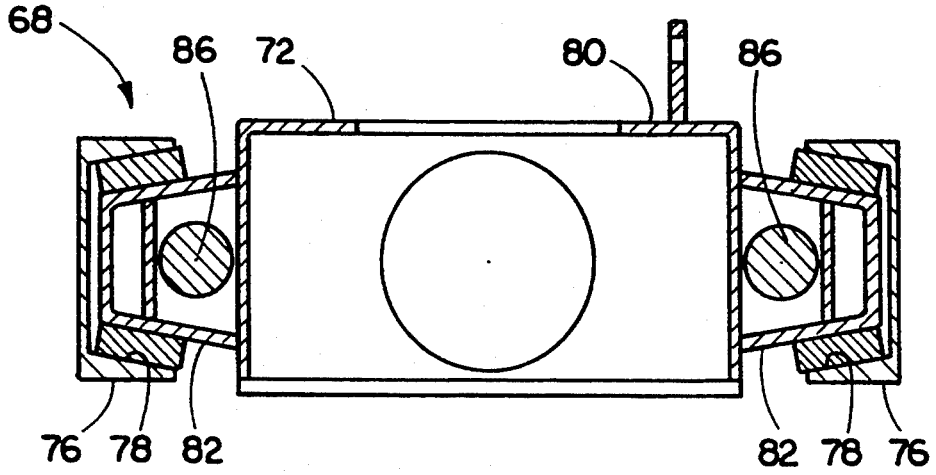
FIG. 23 is a cross-sectional view of the pusher mechanism taken along line 23—23 of FIG. 22.

Referring particularly to FIGS. 1 and 20–23, the pusher mechanism 68 includes an elongated track 70, a movable carriage 72 and an elongated actuator 74 all being disposed at the exterior of the first unit 22 of the casing 26. The track 70 of the pusher mechanism 68 includes a pair of laterally spaced track members 76 mounted to the rear end 22D of the first unit 22 and extending outwardly and rearwardly therefrom in an inclined orientation. The track members 76 being U-shaped in cross-section define a pair of elongated grooves 78 along their interior sides which face toward one another. The carriage 72 of the pusher mechanism 68 has a middle platform 80 and a pair of opposite guide elements 82 attached to and extending in opposite directions from the platform 80. The opposite guide elements 82 of the carriage 72 are mounted in the respective grooves 78 of the track members 76 of the track 70 to undergo sliding reciprocal movement therealong between first and second displaced positions, as seen in FIG. 20, toward and away from the first unit 22 of the casing 26. The actuator 74 of the pusher mechanism 68, preferably in the form of an air cylinder, is mounted at its cylinder end 74A to the rear end 22D of the casing 26 and coupled at an opposite piston rod end 74B to the carriage. Selective operation of the actuator 74 through extension and retraction of its piston rod will cause the sliding reciprocal movement of the carriage 72 between the first and second displaced positions.

The pusher mechanism 68 also includes an elongated pusher arm 84 formed by a pair of parallel rods 86 having a scraper blade 88 mounted transversely across their forward terminal ends. The parallel rods 86 are slidably movable into the first pyrolysis chamber 14 through a pair of hollow collars 90 being rigidly attached to and extending through the rear end 22D of the first unit 22. Rearward ends of the parallel rods 86 of the pusher arm 84 are connected to the carriage 72. The transverse scraper blade 88 engages the upper inclined surface 50 of the refractory mass 40 and any solid material received thereon.

As the actuator 74 is retracted, the carriage 72 and pusher arm 84 are respectively moved toward the casing 12 and front end 22C thereof so as to cause the blade 88 to move toward the first displaced or extended position located near the cavity 52 and thereby transport or push the solid material down the inclined upper surface 50 and over its lower end 50B and into the collection pan 56 in the cavity 52. To reset the pusher mechanism 68, the actuator 74 is extended to retract the carriage 72 away from the casing 12 and the pusher arm 84 from the pyrolysis chamber 14 and thereby move the blade 88 toward the second displaced or retracted position located adjacent to the rear end 22D of the first unit 22 and remote from the cavity 52.

The material dispensing apparatus 10 also includes an arrangement 92 for monitoring the position of the carriage 72 and thereby of the scraper blade 88 as the carriage 72 undergoes reciprocal movement along the track 70 toward and away from the rear end 22D of the first unit 22 of the casing 26. The monitoring arrangement 92 includes a motion transmitting means 94 and an electrical device 96 in the form of a potentiometer. The motion transmitting means 94 is in the form of a plurality of pulleys 98 and a flexible endless cable 100. The pulleys 98 are rotatably mounted to support brackets 102 which, in turn, are mounted across the track members 76 in a non-interfering relation to the carriage 72. The endless cable 98 is entrained about the pulleys 98. The cable 98 is respectively attached to the carriage 72 and to the electrical device 96. The cable 98 moves along an endless path as the carriage 72 undergoes the above-described reciprocal movement along the track 70. The electrical potentiometer 96 is incorporated in an electrical circuit (not shown) and is operable to vary the magnitude of an electrical signal in the circuit in proportion to the position of the carriage 72 along the track 70. By provision of the monitoring arrangement 92, the position of the pusher blade 88 can be determined at all times.

Tunnel And Heater Arrangement In Second Oxidation Chamber

Referring to FIGS. 5–14, as mentioned above the primary section 16A of the second chamber 16 has the tunnel system 38 defined in the refractory mass 40 of the first unit 22 of the casing 26. The tunnel system 38 includes upper inclined tunnels 104, lower horizontal tunnels 106, a rear vertical manifold 108, and front and rear vertical passages 110, 112 connected with selected ones of the upper and lower tunnels 104, 106. The upper inclined tunnels 104 are made up of an upper middle tunnel 104A and a pair of side tunnels 104B spaced outwardly from and extending generally parallel with the upper middle tunnel 104A. The upper middle tunnel 104A defines an inlet 113 open in flow communication with the first pyrolysis chamber 14 at a forward end located below the front end 50B of the upper inclined surface 50 on the refractory mass 40 and within the collection cavity 52. The rear ends of the upper middle and side tunnels 104A, 104B are interconnected in flow communication by the rear vertical manifold 108.

The lower horizontal tunnels 106 are made up of a pair of lower laterally spaced tunnels 106A, 106B which extend generally parallel to one another. The lower horizontal tunnels 106A, 106B at their front ends are connected by a pair of the front vertical passages 110 in flow communication with the front ends of the respective side inclined tunnels 104B of the upper inclined tunnels 104. The lower horizontal tunnels 106A, 106B at their rear ends are connected by a pair of the rear vertical passages 112 and a rear middle horizontal tunnel 114 in flow communication with the outlet 23 from the first unit 22 which communicates with the tubular extensions 26A, 26B of the casing 26. The outlet 23 is located at an elevation between the rear ends of the upper inclined tunnels 104 and the lower horizontal tunnels 106.

Also, a first group of second heater units 20A are mounted to the rear end 22D and the one opposite side 22F of the first unit 22 of the casing 26 so as to extend axially into and along the respective lower horizontal tunnels 106A, 106B and the rear middle horizontal tunnel 114. These second heater units 20A add heating to the gas flow through the tunnel system 38 so as to maintain the gas at the proper elevated temperature.

Due to the vacuum created by operation of the induction fan 42 in the second unit 24, the gas passes in a rearward direction through the upper inclined middle tunnel 104A and then passes in forward directions through the pair of inclined side tunnels 104B after splitting into two gas flows and reversing direction by passing through the rear manifold 112. The two gas flows then travel down through the front vertical passages 110 and into the forward ends of the lower horizontal tunnels 106A, 106B where the gas flow again reverses direction. The two gas flows travel rearwardly and exit the rearward ends of the lower horizontal tunnels 106A, 106B and enter the two rear vertical passages 112 and recombine with one another in the middle horizontal tunnel 114 and exit therefrom and through the outlet 23 of the first unit 22.

The induction fan 42 located above the secondary section 16B of the second chamber 16 thus operates to draw the gases from the first pyrolysis chamber 14 into the primary section 16A of the second oxidation chamber 16 via the front opening of the middle inclined one 104A of the upper tunnels 104. The gas then flows through the upper inclined tunnels 104 of the primary section 16A, back through the lower horizontal tunnels 106 of the primary section and then through the secondary section 16B of the second oxidation chamber 16. The gas then flows up and forwardly through the center of the heat exchanger 48 to the center of the induction fan 42 which then forces the exhaust gas outwardly and rearwardly around and along the heat exchanger 48 for exiting through discharge outlet 36 into a wet scrubber (not shown).

The exhaust gas at the discharge outlet 36 is virtually free of any pollution and the original material has been almost completely oxidized so that only a very small amount of fine minute dust or powder particles are collected in a particle separator (not shown).

Improved Casing And Heater Configuration

Referring to FIGS. 15–18, as described earlier, the second unit 20 of the casing 26 includes therein the lower secondary section 16B of the second chamber 16 and the upper heat exchanger 48. Also, the secondary section 16B of the second chamber 16 includes a second group of the second heater units 20B and a plurality of baffles 116 extending across the flow path through the secondary section 16B of the second chamber 16. The baffles 116 are circular in configuration and are spaced apart axially from one another. The baffles 116 are provided with an arrangement of openings 118 being offset from the centers of the baffles and misaligned with one another. Each second heater unit 20B employed in the secondary section 16B of the second chamber 16 has substantially the same construction and configuration as the first heater unit 18 described above with one difference. The difference is that the electric heating elements 120 of the second heater unit 20B are distributed and spaced about the full circle instead of only about one-half of the circle.

In order to provide access from the exterior of the casing 26 for mounting the second heater units 20B through spaced side portions of the outer and inner walls 28, 30 of the casing 26 and within the second chamber 16, the outer wall 28 of the second unit 24 of the casing 26 has a unique configuration. The outer wall 28 has a substantially inclined figure eight configuration so as to accommodate positioning of the second heater units 20A through the spaced side portions of the outer and inner walls 28, 30 of the casing 26 to extend across the second chamber 16 in substantially vertical orientations.

Further, in the second unit 20 the inner wall 30 of the casing 26 is provided in the form of a plurality of upper inner walls 122 having substantially concentric cylindrical configurations, and a lower inner wall 124. The concentric upper inner walls 122 define an upper airtight portion of the vessel 12 which, in turn, defines the heat exchanger 48. The lower inner wall 124 defines a lower airtight portion of the vessel 12 which contains the secondary section 16B of the second chamber 16. A manifold 126 is defined at the rear end of the second unit 20 of the casing 26 for providing flow communication of gas from the secondary section 16B of the second chamber 16 through the heat exchanger 46 to the discharge outlet 42.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the forms hereinbefore described being merely preferred or exemplary embodiments thereof.

I claim:

1. A material processing apparatus, comprising:

(a) a casing having a top and bottom, a pair of opposite ends and a pair of opposite sides, said casing defining a pyrolysis chamber for receiving and pyrolyzing feed materials therein into fluid materials;

(b) a mass of refractor material contained in said casing upon said bottom thereof and spaced below said top thereof, said refractory mass extending between said opposite ends and said opposite sides thereof, said refractory mass including an upper surface defining a bottom of said pyrolysis chamber and having a pair of opposite upper and lower ends, said upper surface being defined in an inclined orientation extending from said upper end thereof located adjacent to one of said opposite ends of said casing to a lower end thereof located in a spaced relation to the other of said opposite ends of said casing, said refractory mass having a front end extending below said lower end of said inclined upper surface and being spaced from said other of said opposite ends of said casing, said front end of said refractory mass and said other end of said casing defining an elongated cavity disposed in said pyrolysis chamber within said casing adjacent to and below said lower end of said upper inclined surface of said refractory mass in a position to receive residue of pyrolyzed feed materials from said lower end of said upper inclined surface, said refractory mass having flow passage means defined therein, a flow outlet defined at one end of said flow passage means and a flow inlet defined at an opposite end of said flow passage means and being formed in said front end of said refractory mass at a location above a bottom of the residue-receiving cavity and below said lower end of said upper inclined surface of said refractory mass and communicating with said pyrolysis chamber above said inclined upper surface via said residue-receiving cavity;

(c) air flow inlet means connected in flow communication with said pyrolysis chamber for introducing air flow from exterior of said casing into said pyrolysis chamber; and (d) air flow generating means connected in flow communication with said flow outlet of said flow passage means in said refractory mass for drawing air flow into said casing from the exterior thereof via said air flow inlet means and therefrom through said pyrolysis chamber and for drawing fluid materials with said air flow from said pyrolysis chamber into said flow inlet of said flow passage means in said refractory mass via said residue-receiving cavity and then through said flow passage means and therefrom through said flow outlet thereof.

2. The apparatus as recited in claim 1, wherein said upper inclined surface has a generally flat configuration extending between said upper and lower ends thereof.

3. The apparatus as recited in claim 1, wherein said casing has an inlet in said top thereof through which materials can be delivered into said pyrolysis chamber and onto said upper surface of said refractory mass.

4. The apparatus as recited in claim 1, wherein said casing has an opening defined in one of said opposite sides thereof at an end of said cavity for providing access from the exterior of said casing into said cavity.

5. The apparatus as recited in claim 4, further comprising:

an elongated residue collection pan disposed in said elongated cavity and removable through said opening in said one opposite side of said casing.

6. The apparatus as recited in claim 5, further comprising:

means disposed below said collection pan and between said bottom of said casing and said collection pan for producing heating of said collection pan to elevate the temperature of materials therein.

7. The apparatus as recited in claim 1, wherein said casing has a pair of openings each being defined in one of said opposite sides of said casing at respective opposite ends of said cavity for providing access from the exterior of said casing into said cavity.

8. The apparatus as recited in claim 1, wherein said cavity extends between said bottom of said casing and said upper surface of said refractory mass.

9. The apparatus as recited in claim 1, further comprising:

means disposed in communication with said pyrolysis chamber for producing heating in said pyrolysis chamber to cause said pyrolyzing of the feed materials into fluid materials.

10. The apparatus as recited in claim 9, wherein said means for producing heating in said pyrolysis chamber includes at least one heater unit disposed in said pyrolysis chamber above and extending in generally parallel relation to said channel in said refractory mass.

11. The apparatus as recited in claim 1, further comprising:

means disposed in communication with said pyrolysis chamber for producing heating in said pyrolysis chamber to cause said pyrolyzing of the feed materials into fluid materials.

12. The apparatus as recited in claim 11, wherein said means for producing heating in said pyrolysis chamber includes a plurality of elongated electric heater units disposed in said pyrolysis chamber and extending in generally parallel relation to said upper inclined surface of said refractory mass.

13. The apparatus as recited in claim 12, wherein said heater units are disposed along respective opposite sides of said casing.

14. A material processing apparatus, comprising:

(a) a casing having a top and bottom, a pair of opposite ends and a pair of opposite sides, said casing defining a pyrolysis chamber for receiving and pyrolyzing feed materials therein into fluid materials;

(b) a mass of refractory material contained in said casing upon said bottom thereof and spaced below said top thereof, said refractory mass extending between said opposite ends and said opposite sides thereof, said refractory mass including an upper surface defining a bottom of said pyrolysis chamber and having a pair of opposite upper and lower ends, said upper surface being defined in an inclined orientation extending from said upper end thereof located .adjacent to one of said opposite ends of said casing to a lower end thereof located in a spaced relation to the other of said opposite ends of said casing, said refractory mass having a front end extending below said lower end of said inclined upper surface and being spaced from said other of said opposite ends of said casing, said front end of said refractory mass and said other end of said casing defining an elongated cavity disposed in said pyrolysis chamber within said casing adjacent to and below said lower end of said upper inclined surface of said refractory mass, said cavity extending between said bottom of said casing and said upper surface on said refractory mass in a position to receive residue of pyrolyzed feed materials from said lower end of said upper inclined surface, said refractory mass having flow passage means defined therein, a flow outlet defined at one end of said flow passage means and a flow inlet defined at an opposite end of said flow passage means and being formed in said front end of said refractory mass at a location above a bottom of the residue-receiving cavity and below said lower end of said upper inclined surface of said refractory mass and communicating with said pyrolysis chamber above said inclined upper surface via said residue-receiving cavity;

(c) air flow inlet means connected in flow communication with said pyrolysis chamber for introducing air flow from exterior of said casing into said pyrolysis chamber; and (d) air flow generating means connected in flow communication with said flow outlet of said flow passage means in said refractory mass for drawing air flow into said casing from the exterior thereof via said air flow inlet means and therefrom through said pyrolysis chamber and for drawing fluid materials with said air flow from said pyrolysis chamber into said flow inlet of said flow passage means in said refractory mass via said residue-receiving cavity and then through said flow passage means and therefrom through said flow outlet thereof;

(e) an elongated residue collection pan disposed in said elongated cavity and removable through said opening in said one opposite side of said casing; and (f) means disposed in communication with said pyrolysis chamber for producing heating in said pyrolysis chamber to cause said pyrolyzing of the feed materials into the fluid materials.

15. The apparatus as recited in claim 14, wherein said casing has an opening defined in one of said opposite sides thereof at an end of said cavity for providing access from the exterior of said casing into said channel.

16. The apparatus as recited in claim 14, wherein said means for producing heating in said pyrolysis chamber includes at least one heater unit disposed in said pyrolysis chamber above and extending in generally parallel relation to said channel in said refractory mass.

17. The apparatus as recited in claim 14, wherein said means for producing heating in said pyrolysis chamber includes a plurality of elongated electric heater units disposed in said pyrolysis chamber and extending in generally parallel relation to said upper inclined surface of said refractory mass.

18. The apparatus as recited in claim 17, wherein said heater units are disposed along respective opposite sides of said casing.

19. The apparatus as recited in claim 14, further comprising:

means disposed below said collection pan and between said bottom of said casing and said collection pan for producing heating of said collection pan to elevate the temperature of materials therein.

* * * * *